US009126714B2

(12) United States Patent
Trani et al.

(10) Patent No.: US 9,126,714 B2
(45) Date of Patent: Sep. 8, 2015

(54) RECLOSABLE CONTAINER AND PROCESS FOR MANUFACTURING SAID CONTAINER STARTING FROM A SHEET MATERIAL

(75) Inventors: Giorgio Trani, Venice (IT); Marion Sterner, Venice (IT); Gianmario Anghileri, Malgrate (IT)

(73) Assignees: NOVACART S.P.A., Garbagnate Monastero (IT); Giorgio Trani, Venice (IT)

( * ) Notice: Subject to any disclaimer, the term of this patent is extended or adjusted under 35 U.S.C. 154(b) by 208 days.

(21) Appl. No.: 13/877,555

(22) PCT Filed: Oct. 7, 2011

(86) PCT No.: PCT/IB2011/054426

§ 371 (c)(1),
(2), (4) Date: Jun. 4, 2013

(87) PCT Pub. No.: WO2012/046215

PCT Pub. Date: Apr. 12, 2012

(65) Prior Publication Data

US 2013/0320077 A1 Dec. 5, 2013

(30) Foreign Application Priority Data

Oct. 8, 2010 (IT) ..... M12010A1845

(51) Int. Cl.
*B31B 3/00* (2006.01)
*B65D 3/26* (2006.01)
(Continued)

(52) U.S. Cl.
CPC ..... *B65D 3/268* (2013.01); *B65D 43/0229* (2013.01); *B31B 1/46* (2013.01); *B31B 3/00* (2013.01); *B31B 2201/2695* (2013.01); *B65D 2543/00092* (2013.01); *B65D 2543/00268* (2013.01); *B65D 2543/00296* (2013.01); *B65D 2543/00425* (2013.01); *B65D 2543/00435* (2013.01); *B65D 2543/00509* (2013.01);
(Continued)

(58) Field of Classification Search
CPC .... B31B 3/00; B31B 2201/2666; B31B 1/46; B31B 1/44; B31B 2201/2654; B31B 45/00; B31B 2201/2695; B31B 2203/00; B31B 1/50; B31B 2201/6095; B31B 2203/003
See application file for complete search history.

(56) References Cited

U.S. PATENT DOCUMENTS 2,395,209 A 2/1946 Zesbaugh
3,301,464 A 1/1967 Amberg
(Continued)

FOREIGN PATENT DOCUMENTS

CH 178 769 A 7/1935
EP 0 453 573 A1 10/1991
(Continued)

*Primary Examiner* — Sameh Tawfik
(74) *Attorney, Agent, or Firm* — Pearne & Gordon LLP

(57) ABSTRACT

The invention relates to a process for realizing a re-closable container made of extensible paper, which comprises at least partly inserting a closing element (5) made of paper material (extensible paper) provided with a base wall (6) and a lateral wall (7), internally of a housing compartment (4) of the container. The lateral wall (7) of the closing element (5) is inserted and located at a portion of lateral wall of the container (1). A sealing layer (204) is coupled to the container in a position underlying the closing element (5). Also comprised is a contemporary deforming step of the lateral wall (7), the sealing layer (204) and the portion of wall of the container (1), such as to realize coupling/decoupling surfaces between the closing element (5) and the container (1).

14 Claims, 25 Drawing Sheets

(51) Int. Cl.
*B65D 43/02* (2006.01)
*B31B 1/46* (2006.01)

(52) U.S. Cl.
CPC ..... *B65D2543/00546* (2013.01); *B65D 2543/00962* (2013.01)

(56) References Cited

U.S. PATENT DOCUMENTS

2004/0056080 A1 3/2004 Johansson et al.
2008/0264895 A1 10/2008 Prieto et al.
2012/0108407 A1 5/2012 Trani et al.

FOREIGN PATENT DOCUMENTS

EP 1 057 748 A1 12/2000
GB 428 909 A 5/1935
GB 468 161 A 6/1937
GB 688 545 A 3/1953
GB 643 674 A 9/1956
GB 848 835 A 9/1960
GB 2 382 873 A 6/2003
GB 2 409 964 A 7/2005
WO 2010116223 A2 10/2010

100
114
105
109
110
111
115
113
115
113a
115
112
113
112
113
112
113

RECLOSABLE CONTAINER AND PROCESS FOR MANUFACTURING SAID CONTAINER STARTING FROM A SHEET MATERIAL

The present invention relates to a paper container, for example having one or more pieces of stretched paper, with a suitable closing element.

In particular, the object of this invention is a container made of paper provided with a closing cap, also made of paper material (e.g. extensible paper) which is removably engageable, for example by screwing/unscrewing, to an opening of the container.

Furthermore, the invention concerns a process and an apparatus for the manufacture of the above-mentioned container in paper material and for coupling a respective cap to the container.

As is known, the use of containers made of paper material, especially for the storage of food products, is widespread on the market.

It is also known that some types of containers require the use of caps or covering elements able to maintain the product more effectively insulated and contained, if not sealed (airtight and liquid-proof) internally of the compartment containment. For example, the invention may relate to beakers for containing soft drinks such as orange juice or sweet drinks, coffee. In order to avoid spillage or contamination of the liquid suitable plastic caps have been made of moulded plastic material, able to snap-fit to the reinforced rim of the paper beaker.

It is clear that this type of product, although widespread on the market, has problematic issues involving the disposal of various materials (paper and plastic) present within the same product. In addition, the cap-container coupling and therefore the sealing performance of the container can be easily compromised, due especially to the type of coupling realised there-between. For example, by radially squeezing the beaker, the plastic cap can easily disengage. In order to solve at least a part of the mentioned drawbacks, in British patent GB 688545, bottles and screw caps are described, which are screwable at a thread that is exclusively external on the outer surface of the bottle neck. The caps can be made of paper impregnated with polythene, while the bottle is clearly composed of rigid material, though unspecified.

Patent GB643674 relates to an improvement for closing caps of bottles, and illustrates a structure in which the paper cap, appropriately threaded, is extremely complex and defined by a plurality of superposed flat layers of paper, bonded together and suitably deformed. It is clear that this type of product too is complex and expensive to implement, as well as being rather unreliable.

A further container made of paper material, with a threaded closing element, is presented in document GB 428909, which illustrates a beaker structure in which the upper portion thereof is threaded in order to receive an inverted cap, the corresponding threads of which are in use, arranged internally of the chamber of the beaker. With reference to this invention too, however, certain drawbacks are highlighted, in particular the sealing requirement that caps made of threaded paper material should have, but which they do not manage to guarantee.

Document GB 468161 addresses this drawback, pointing out the difficulty of realising threads on the container neck and cap that essentially coincide, so as to ensure the best possible resistance to fluids in the container. In order to obviate the drawback, the above-mentioned document GB 468161 teaches realising threads on the container and caps that are slightly different, so that, when the enmeshing force is generated during coupling, a further force is generated that improves the container seal. It is clear however that this type of solution involves the realising of two different devices, the first to create the thread on the paper container, the second to realise the different thread on the cap, in a controlled differentiated way.

Each type of container also involves realising machines dedicated to the above-mentioned aims. From the point of view of the production methodologies of containers with caps made of paper material, mention is exclusively made of GB patent GB2382873, illustrating a method for producing a threaded screw cap. In particular, the apparatus used exploits the presence of a plurality of expandable areas located internally of the cap structure to be realised, which are moved radially and impress a groove-shaped spiral on the inner surface of the cap side wall. It should however be noted that the methodology adopted by the above-cited GB patent has the drawback of the realising of interrupted threads.

In fact, the expansion of the male-threaded angular sectors internally of the cap necessarily leaves undeformed zones on the cap due to the necessary forces during the opening stage. This leads to interruptions in the profile of the thread, which consequently generate dealignment of the cap during the screwing stage and/or deformations on the cap itself such as to cause the cap to lose seal on the container. With the aim of guaranteeing a sealing of the closure, a solution described in European patent EP 0453573 relates to a beaker that is capped at an end thereof by a cap which, at a perimeter interface edge between cap and glass, exhibits a stamped annular sealing gasket.

SUMMARY

In this situation the technical objective at the base of the present invention is to substantially obviate all the above-mentioned drawbacks.

A first aim of the invention is to provide containers made of paper material, provided with caps, also made of paper and removably engageable, for example screwable, which are however able to guarantee an effective seal. A further aim of the invention is to provide containers and caps therefore which are easy to realise. Further, an aim of the invention is to realise containers and relative caps that while guaranteeing optimal seal to the product contained internally, also enable a simple opening and closing, repeated many times, of the container.

An aim of the invention is also to make available a methodology of realisation of the container-cap system that can be used during production and also during the step of packing, thus guaranteeing considerable advantages in both situations.

An auxiliary aim of the invention is to make available a production method and a relative closing system that enables sealing the contents, while maintaining the possibility, once the container is open, of removably re-closing it.

A further auxiliary aim is to provide the possibility of customising the profile of the container/cap thanks to the possible adoption of extensible paper.

At least one of the set aims is substantially attained by a process for realising a container made of paper material and a container as described in one or more of the accompanying claims.

Aspects of the invention are now described in summary form.

A 1st aspect concerns a process for realising a reclosable container, starting from a sheet comprising following steps: predisposing, starting from a sheet material, a structure defining internally thereof at least a chamber, the chamber exhibiting at least an access delimited by a portion (3*a*) of wall of the structure and by a free edge of the wall;

predisposing, starting from a sheet material, a closing element, having a base wall and a lateral wall emerging from the base wall;

predisposing, starting from a sheet material, a sealing layer, optionally placed superposingly on the base wall and on at least a portion of the lateral wall of the closing element;

associating the closing element and the sealing layer to the structure such as at least partly to close the access, the lateral wall of the closing element being positioned at the portion of the wall of the structure and the sealing layer comprising a lateral portion interposed between the portion of the lateral wall and the lateral wall of the closing element; and deforming at least a part of the lateral wall of the closing element and at least a part of the portion of wall of the container with the lateral portion of the layer interposed there-between.

In a 2nd aspect, in accordance with the 1st aspect, the sealing layer is located superposingly with the base wall, and with at least a portion of the lateral wall of the closing element.

In a 3rd aspect according to the first or second aspect, the predisposing of the closing element and the sealing layer comprise a contemporaneous deforming such that the sealing layer follows the profile of at least the base body and the lateral wall of the closing element.

In a 4th aspect, in accordance with any one of the preceding aspects, the step of deforming is successive to the step of association.

In a 5th aspect, in accordance with any one of the preceding aspects, the step of deforming comprises contemporaneous deforming of the lateral wall of the closing element, the part of the portion of wall of the container and the lateral portion of the layer interposed there-between In a 6th aspect, in accordance with any one of the preceding aspects, the step of deformation comprises making identical the shape of the part of the lateral wall of the closing element, of the part of the portion of wall of the container, and the lateral portion of the layer interposed there-between.

In a 7th aspect, in accordance with any one of the preceding aspects, the base wall and the lateral wall of the closing element are realise in at least a first material, and the sealing layer is realised in a second material that is different from the first material.

In an 8th aspect, in accordance with any one of the preceding aspects, the base wall and the lateral wall of the closing element are realised such that following the deforming step an adhesion force per unit of surface is defined between the portion of wall of the container and the lateral portion of the layer that is significantly higher than an adhesion force per unit of surface between the lateral portion of the layer and the lateral wall of the closing element. In other words, the surface of mutual contact between the closing element and the sealing layer generates an overall coupling force that is lower than the force joining the layer (and in particular the lateral portion of the layer) to the surface of the wall of the structure or container.

In a 9th aspect, in accordance with any one of the preceding aspects, the base wall and the lateral wall of the closing element are realised in at least a first material, and the sealing layer is realised in a second material that is different to the first material, the first and the second material being selected such that following the deforming step an adhesion force is defined per unit of surface between the portion of wall of the container and the lateral portion of the layer which is considerably greater than an adhesion force per unit of surface between the lateral portion of the layer and the lateral wall of the closing element.

In a 10th aspect, in accordance with any one of the preceding aspects, the second material with which the sealing layer is realised comprises at least a continuous plastic film extending to close the chamber or a part thereof and able to realise a substantial seal against air and gases used in the food industry for defining controlled-atmosphere environments.

In an 11th aspect, in accordance with any one of the preceding aspects, the first material of which the closing element is realised is one selected from among the group, comprising: a paper material, a paper material with a covering film such as for example a single polyolefin, a paper material with a plurality of covering films among which at least a plastic film, for example a polyolefin, and at least a metal film, for example made of aluminium.

In a 12th aspect, in accordance with any one of the preceding aspects, at least one layer of the base wall and the lateral wall of the closing element destined to be faced towards and in contact with the sealing layer is made of a material that is not chemically compatible with the second material.

In a 13th aspect, in accordance with any one of the preceding aspects, the structure is realised in a material selected from among the group, comprising: a paper material, a paper material with a covering film such as for example a single polyolefin, made of a paper material with a plurality of covering films among which at least a plastic film, for example a polyolefin, and at least a metal film, for example made of aluminium.

In a 14th aspect, in accordance with any one of the preceding aspects, at least a layer of the container wall destined to be facing towards and in contact with the sealing layer is realised in a chemically compatible material (i.e. able to chemically bond to achieve an effective attachment) with the second material.

In a 15th aspect, in accordance with any one of the preceding aspects, both the second material and the material of the at least a layer of the wall of the container destined to be facing towards and in contact with the sealing layer comprise a polyolefin.

In a 16th aspect, in accordance with any one of the preceding aspects, a part of the material forming the lateral portion of the sealing layer comprises a plastic material.

In a 17th aspect, in accordance with any one of the preceding aspects, at least a part of the material forming the portion of the wall comprises a plastic material.

In an 18th aspect, in accordance with any one of aspects 16 and 17, during the deforming stage, the plastic material or at least a part of the plastic material is brought to a softening or melting temperature of the plastic material, the lateral portion consequently sealedly welding to the portion of the wall.

In a 19th aspect, in accordance with any one of the preceding aspects, the step of deformation comprises realising grooves on the part of the lateral wall of the closing element, on the part of the portion of wall of the container and on the lateral portion of the layer interposed there-between.

In a 20th aspect, in accordance with any one of the preceding aspects, the step of deformation comprises realising grooves defining coupling/decoupling surfaces for rotating between the closing element and the container.

In a 21st aspect, in accordance with any one of the preceding aspects, the step of predisposing a container made of paper material defining internally thereof at least a housing chamber, the chamber exhibiting at least an access delimited by a portion of wall of the structure and by a free edge of the wall.

In a 22nd aspect, in accordance with any one of the preceding aspects, the step of associating comprises associating the container to the closing element made of paper material and to the sealing layer in such a way as to insert the base wall of the closing element into the container compartment, at least partially through the access, the lateral wall of the closing element being inserted internally of the container compartment at the wall portion of the container and the sealing layer realising a sealed closure of the containing compartment.

In a 23rd aspect, in accordance with any one of the preceding aspects, the step of deformation enables obtaining grooves on the container, on the sealing layer and on the closing element in reciprocal coupling conditions thereof.

In a 24th aspect, in accordance with any the preceding aspect, the grooves define respective threads extending on the surface over a development of more than 120°.

In a 25th aspect, in accordance with any the preceding aspect, the grooves define respective threads extending on the surface over a development of more than 360°.

In a 26th aspect, in accordance with any the preceding aspect, the grooves define respective threads extending on the surface over a development of more than 540°.

In a 27th aspect, in accordance with any one of the preceding aspects, the lateral portion of the sealing layer extends along the grooves.

In a 28th aspect, in accordance with any one of the preceding aspects, the step of deformation comprises a substep of inserting a shaped portion into the cavity of the structure, the shaped portion exhibiting gullies facing externally of the shaped portion and further substeps of: predisposing mobile deforming organs external of the structure exhibiting ribs substantially complementarily-shaped to the gullies of the shaped portion; and moving the mobile organs nearingly to the structure such as to at least partially insert the ribs internally of the gullies.

In a 29th aspect, in accordance with the preceding aspect, corresponding parts of the lateral wall of the closing element, the lateral portion of the layer and the portion of lateral wall of the container are trapped between the gullies and ribs and are deformed, following the nearing, such as to define the grooves for coupling/decoupling by rotation between the closing element and the container.

In a 30th aspect, in accordance with the preceding aspect, the substep of moving the organs comprises a nearing thereof to the shaped portion in a direction contained in a perpendicular plane to a development axis of the container, the nearing direction being for example a radial direction.

In a 31st aspect, in accordance with one of aspects from 27 to 29, each mobile organ exhibits respective ribs, the ribs of all the mobile organs defining a continuous helical rib when in gripping conditions on the container.

In a 32nd aspect, a container made according to the process of any one of the preceding aspects is disclosed.

In a 33rd aspect, a container is provided, for example made according to the process of any one of the preceding aspects, comprising a structure made of paper material defining a housing chamber, exhibiting at least an access delimited by a portion of wall and a free edge;

a closing element made of a paper material having a base wall (6), a lateral wall (7) emerging from the base wall; and a sealing layer for closing the housing chamber.

In a 34th aspect, according to the preceding aspect, the closing element in an engaged condition, coupled to the structure in order to at least partly close the access, with the lateral wall of the closing element positioned at the portion of the wall of the structure, in the engaged condition of the closing element, the sealing layer is located superposingly on the base wall and on at least a portion of the lateral wall, the sealing layer comprising a lateral portion interposed between the portion of the wall of the structure and the lateral wall of the closing element, and sealingly fixed to the portion of the wall, and the closing element is separable from the structure and displaceable into a disengaged condition from the structure, without compromising the sealing fixture of the lateral portion to the portion of the wall of the structure.

In a 35th aspect, according to any one of the preceding claims from 32 to 34, the lateral portion of the lateral wall of the closing element, the portion of wall of the container and the lateral portion of the layer interposed there-between have an identical shape, obtained by contemporary deformation thereof.

In a 36th aspect, according to any one of the preceding claims from 32 to 35, the base wall and the lateral wall of the closing element are realised in at least a first material and the sealing layer is realised in a second material, different to the first material.

In a 37th aspect, according to the preceding claim, the first and the second material are selected so that, following the deformation step, an adhesion force is defined per unit of surface between the portion of wall of the container and the lateral portion of the layer which is considerably greater than an adhesion force per unit of surface between the lateral portion of the layer and the lateral wall of the closing element.

In a 38th aspect according to any one of the preceding claims from 36 to 37, the second material of the sealing layer comprises at least a continuous plastic film extending to close the chamber or a part thereof and able to realise a substantial seal against gas.

In a 39th aspect according to any one of the preceding claims from 36 to 38, the first material with which the closing element is realised is one selected from a group comprising: a paper material, a paper material with a covering film such as for example a single polyolefin, a paper material with a plurality of covering films among which at least a plastic film, for example a polyolefin, and at least a metal film, for example made of aluminium.

In a 40th aspect, according to any one of the preceding claims from 36 to 39, at least a layer of the base wall and the lateral wall of the closing element (5) destined to be facing towards and in contact with the sealing layer is made of a material which is not chemically compatible with the second material.

In a 41st aspect according to any one of the preceding claims from 32 to 40, the structure is made of a material selected from a group comprising: a paper material, a paper material with a covering film such as for example a single polyolefin, a paper material with a plurality of covering films among which at least a plastic film, for example a polyolefin, and at least a metal film, for example made of aluminium.

In a 42nd aspect according to any one of the preceding claims from 36 to 41, at least a layer of the container wall destined to be facing towards and in contact with the sealing layer (204) is made of a material which is chemically compatible with the second material.

In a 43rd aspect according to any one of the preceding claims from 32 to 42, at least a part of the material forming the lateral portion of the sealing layer comprises a plastic material.

In a 44th aspect according to any one of the preceding claims from 32 to 43, at least a part of the material forming the portion of the wall comprises a plastic material.

In a 45th aspect according to any one of the preceding claims from 43 or 44, the lateral portion, during the deformation in which the plastic material is brought to a softening or melting temperature, sealingly welds with the portion of the wall by hot-deforming of the portions themselves.

In a 46th aspect according to any one of the preceding claims from 32 to 45, the portion of wall of the containing structure, the lateral wall of the closing element and the lateral portion interposed there-between exhibit corresponding coupled grooves.

In a 47th aspect according to any one of the preceding claims from 32 to 46, the portion of wall of the containing structure, the lateral wall of the closing element and the lateral portion interposed there-between exhibit corresponding coupled grooves destined to define coupling/decoupling surfaces by rotation, between the closing element and the containing structure.

In a 48th aspect according to the preceding claim, the grooves define relative threads extending on the surface over an extension of more than 120°.

In a 49th aspect according to the preceding claim, the grooves define relative threads extending on the surface over an extension of more than 360°.

In a 50th aspect according to the preceding claim, the grooves define relative threads extending on the surface over an extension of more than 540°.

In a 51st aspect according to any one of aspects from 48 to 50, the lateral portion of the sealing layer extends along the grooves.

In a 52nd aspect according to any one of aspects from 32 to 51, the base wall and the lateral wall of the closing element are inserted through the access of the housing compartment, the containing structure exhibiting a flat portion emerging distancingly from the free edge, the closing element exhibiting a corresponding flat portion emerging from the lateral wall, the flat portions being at least partially in contact with one another and defining at least a further reciprocal constraining zone with an unremovable coupling.

In a 53rd aspect according to any one of aspects from 32 to 52, the base wall exhibits an access destined to define a passage between the containing compartment and the external environment in coupling conditions of the structure to the closing element.

In a 54th aspect according to the 53rd, the container further comprises a sealing body destined to hermetically close the access, the sealing body being still more preferably de-filmable in order for the passage to be opened.

In a 55th aspect, according to any one of aspects from 32 to 54, a further sealing element is comprised, for example a film, for enabling a closing of a volume defined internally of the closing element on an opposite side to the compartment defined by the base wall, preferably a hermetic closure.

BRIEF DESCRIPTION OF THE DRAWINGS

Further characteristics and advantages will more fully emerge from the detail description that follows, of a preferred but not exclusive embodiment of a container as well as of a method and an apparatus for realising containers in paper material, and a relative closing cap, according to the invention.

The description will be made in the following with reference to the accompanying figures of the drawings, provided by way of non-limiting example, in which.

DETAILED DESCRIPTION

Figure 1:
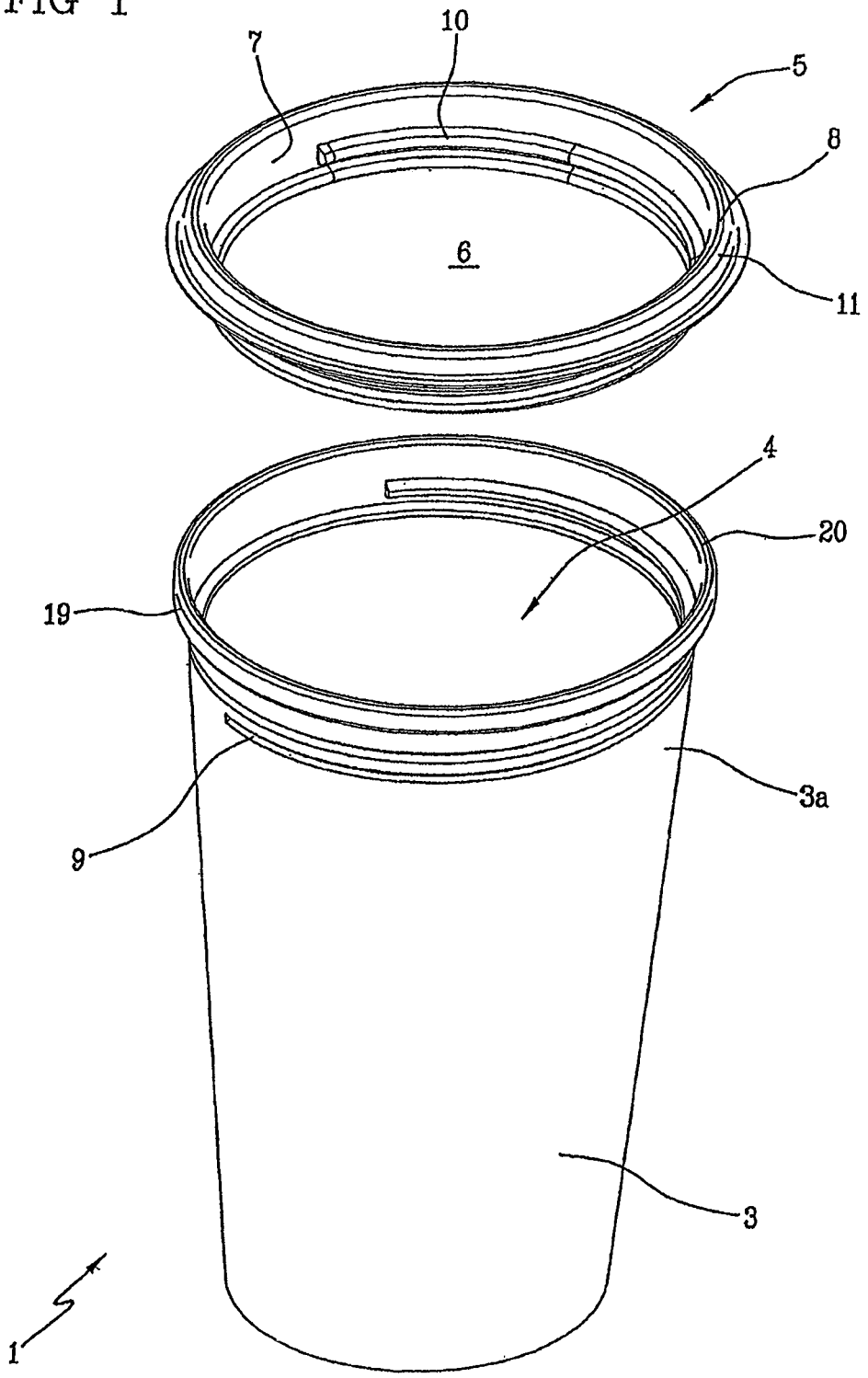
FIGS. 1 and 2 illustrate, in perspective and exploded view, a possible embodiment of a paper container.

With reference to the FIG. 1 denotes in its entirety a container made of a paper material, with a screw-on cap 5.

In the embodiment illustrated in FIGS. 1, 2, 9-11 and 15 to 19, the container is constituted by a bottom wall 2 to which a lateral wall 3 is constrained, emerging from the bottom 2 such as to define, in co-operation, a housing compartment 4 for the product to be contained.

In the specific case (non-limiting) the product to be contained might be a beverage or the like and the container 1 is defined by a beaker made of paper internally lined with a film for use with foodstuffs, such as a single polyolefin (polyethylene or polypropylene or another) or coupled with aluminium, EVOH or other barrier layers.

In other words, in general the use of a paper (plain or extensible) coupled (mechanically) to a polyolefin film ensures additional advantageous aspects of the product, as will be more fully described in the following.

The bottom wall 2 exhibits in section a vertical plane having an upturned U-profile, of a conventional type in such a way as to define a perimeter edge 2*a* destined to be sealed to the lateral wall 3 (FIGS. 1, 2 and 2*a*, 15 and 16).

The lateral wall exhibits a truncated cone shape emerging from the bottom wall 2, having a circular plan shape and terminating in a free upper edge 3*a* defining the mouth of the beaker, which is also substantially circular.

The bottom wall and the lateral wall 2 and 3 define in cooperation a housing compartment 4, in suitable for receiving the product/products to be contained.

It is quite clear, however, that for the purposes of the exhibit invention the shape of the container, as well as the fact that it is realised starting from a single sheet of paper material or from a plurality of sheets suitably constrained to one another is entirely by way of example, and therefore irrelevant.

Figure 8:
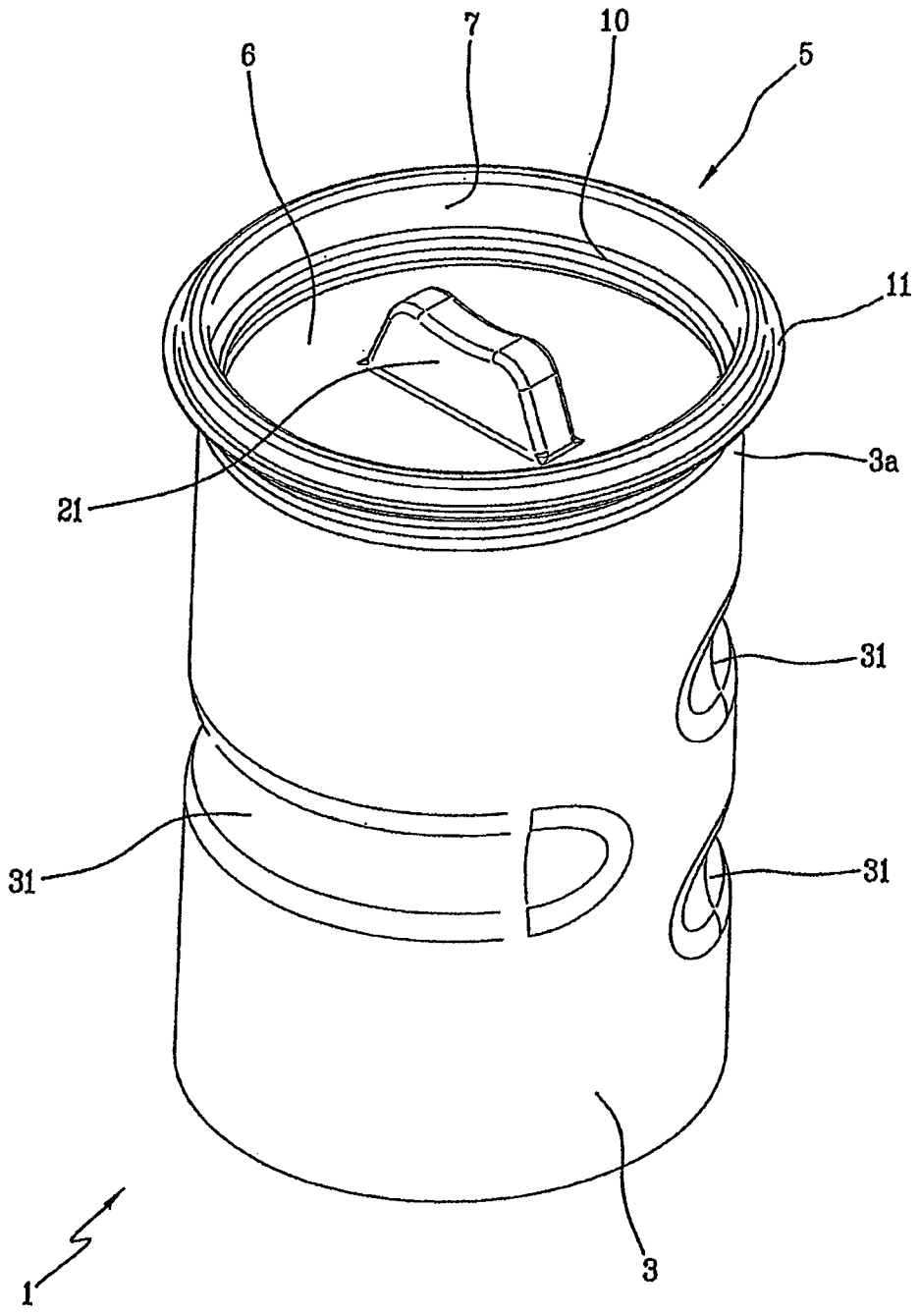
FIG. 8 shows a further example of a container made of extensible paper.
Figure 12A:
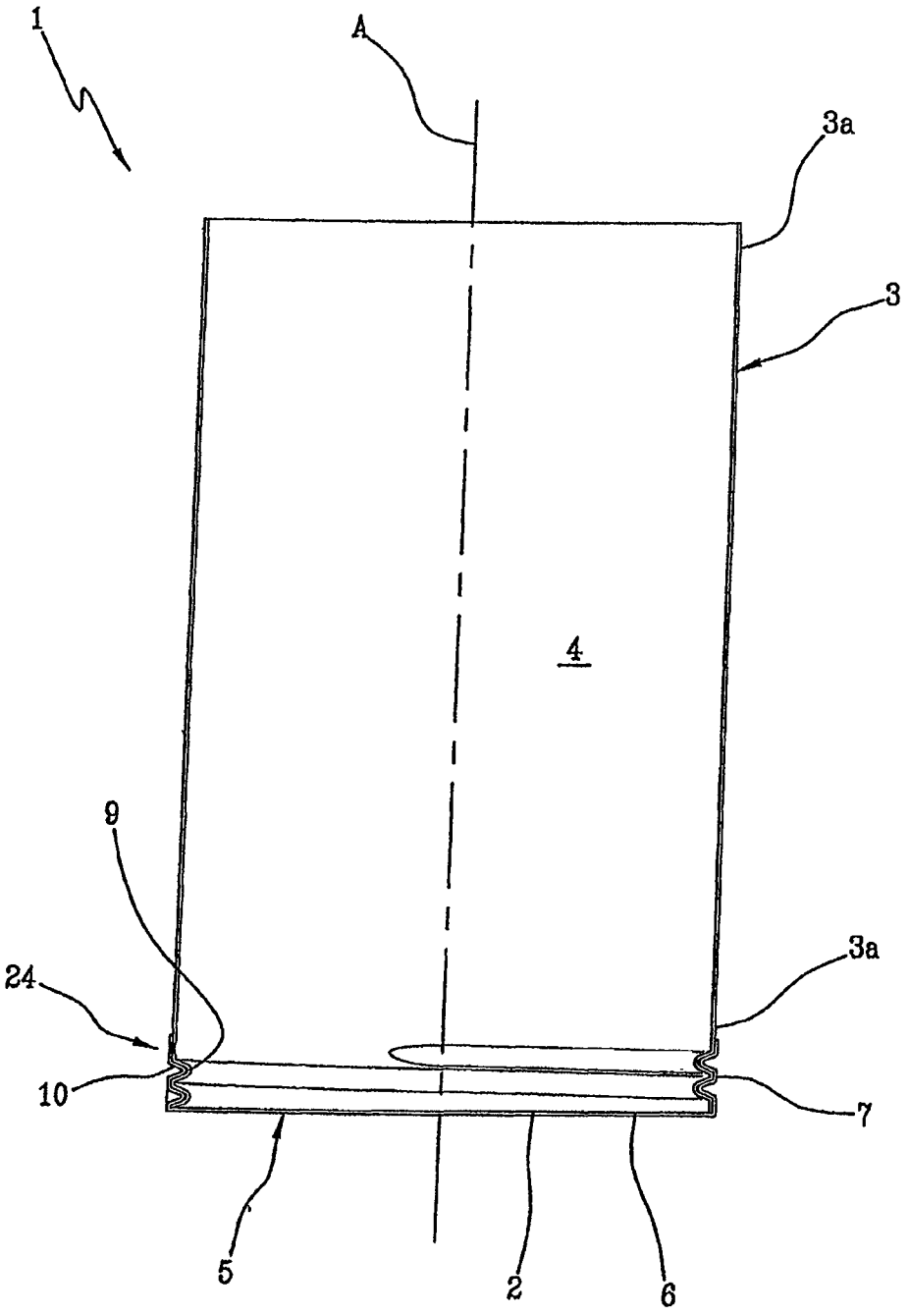
Figure 12B:
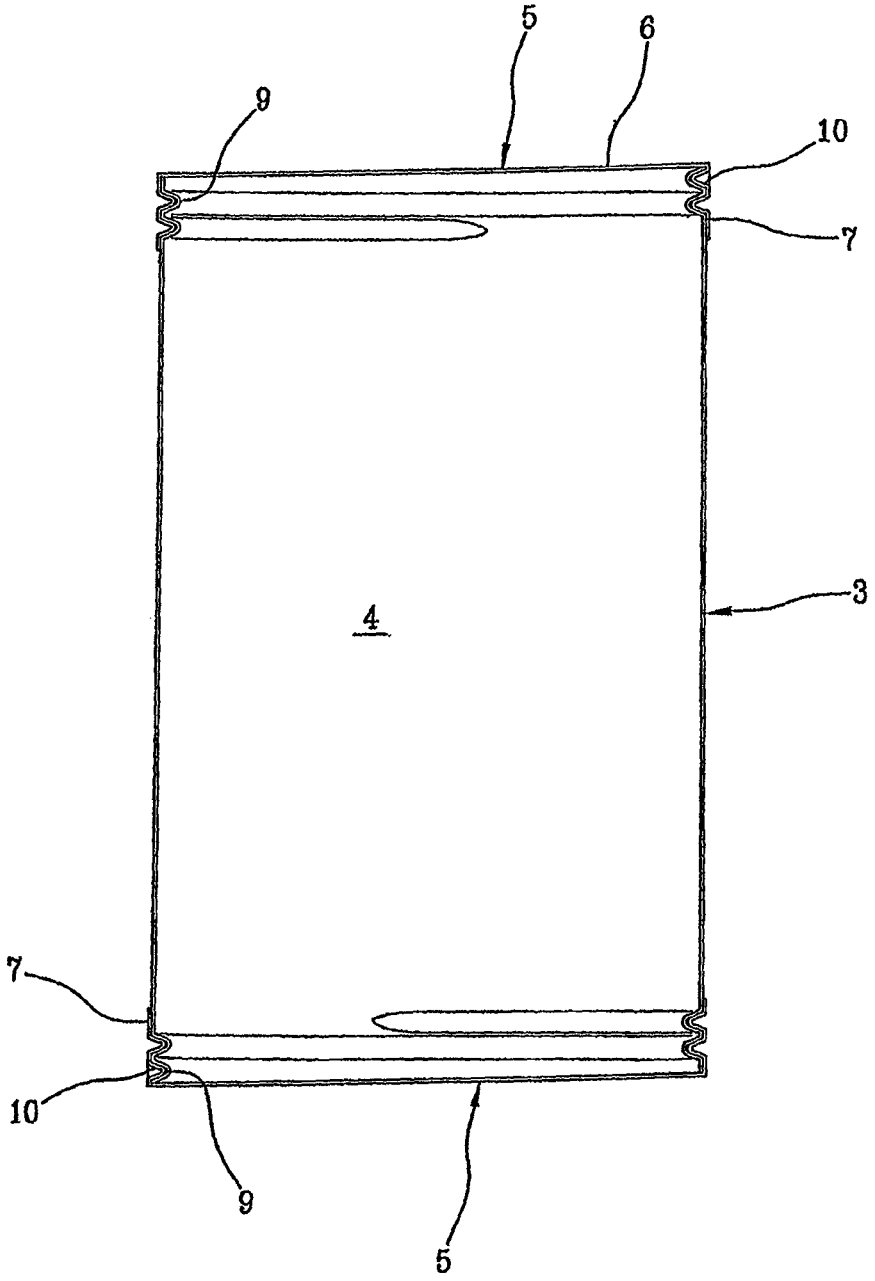

Purely by way of example, the container of FIG. 8 exhibits a substantially cylindrical shape, but with deformations of the lateral wall 3 and the closing element 5, obtained through the use of extensible paper; the container of FIGS. 12*a* and 12*b* instead illustrates a containing structure 1 that defines the compartment 4 that is constituted by a cylindrical tubular element having two accesses that can be individually removably closed.

As previously mentioned, if intended to come into contact with foodstuffs such as beverages, the paper materials defining the container will be coated at least at the surface facing towards the cavity 4 with the appropriate plastic film for foodstuffs, such as a polyolefin. For example a tape is used to cover the longitudinal edge of the sheet.

The container also has at least one closing element 5 exhibiting a base wall 6 having a substantially circular profile which exhibits a lateral wall 7, for example having a conical progression, preferably ending in a top flap 8 directed radially and towards the outside of the lateral wall 7.

In the embodiment illustrated in FIGS. 1, 2, 2*a*, 8, 9*a*, 9*b*, 9*c*, 10, 10*a*, 10*b*, 11, and from 15 to 19, the covering element 5 is destined, in use, to be housed internally (at least partly) of the containing chamber of the container 4.

In other terms, the base 6 has a plan size such as to enable insertion internally of the upper portion 3*a* of the lateral wall 3 of the container; in turn, the lateral wall 5 of the lateral element 7 of the closing element 5 is substantially complementarily shaped with respect to the access area 3*a* of the container, perfectly marrying the internal surface. Further, the folded edge 8 of the closing element is, in use, destined to abut against the free upper edge 20 of the container.

Differently, FIGS. 12*a* and 12*b* show a closing element 5 which is externally coupled to the lateral wall 3 (or the lateral wall 7 can be external of the containing compartment 4). Note however that the coupling geometries of the lateral wall 7 of the closing element 5 to the upper portion 3*a* of the lateral wall 3 of the container may be different from those represented herein by way of example.

In other words, in addition to a truncated cone shape open at the top, the portions may for example be perfectly cylindrical (FIGS. 8 and 12) without forsaking the inventive concept of the present invention.

Note however that both the container and the closing element can be either or both made starting from extensible paper, i.e. paper able to withstand, without breakage, deformations of greater than 5% (up to 20%).

In this sense complex shapes of the container can be defined, which might exhibit textures, curved walls, or more besides according to the needs of the moment. This enables obtaining the containers having shapes other than cylindrical or truncoconical.

Figure 9A:
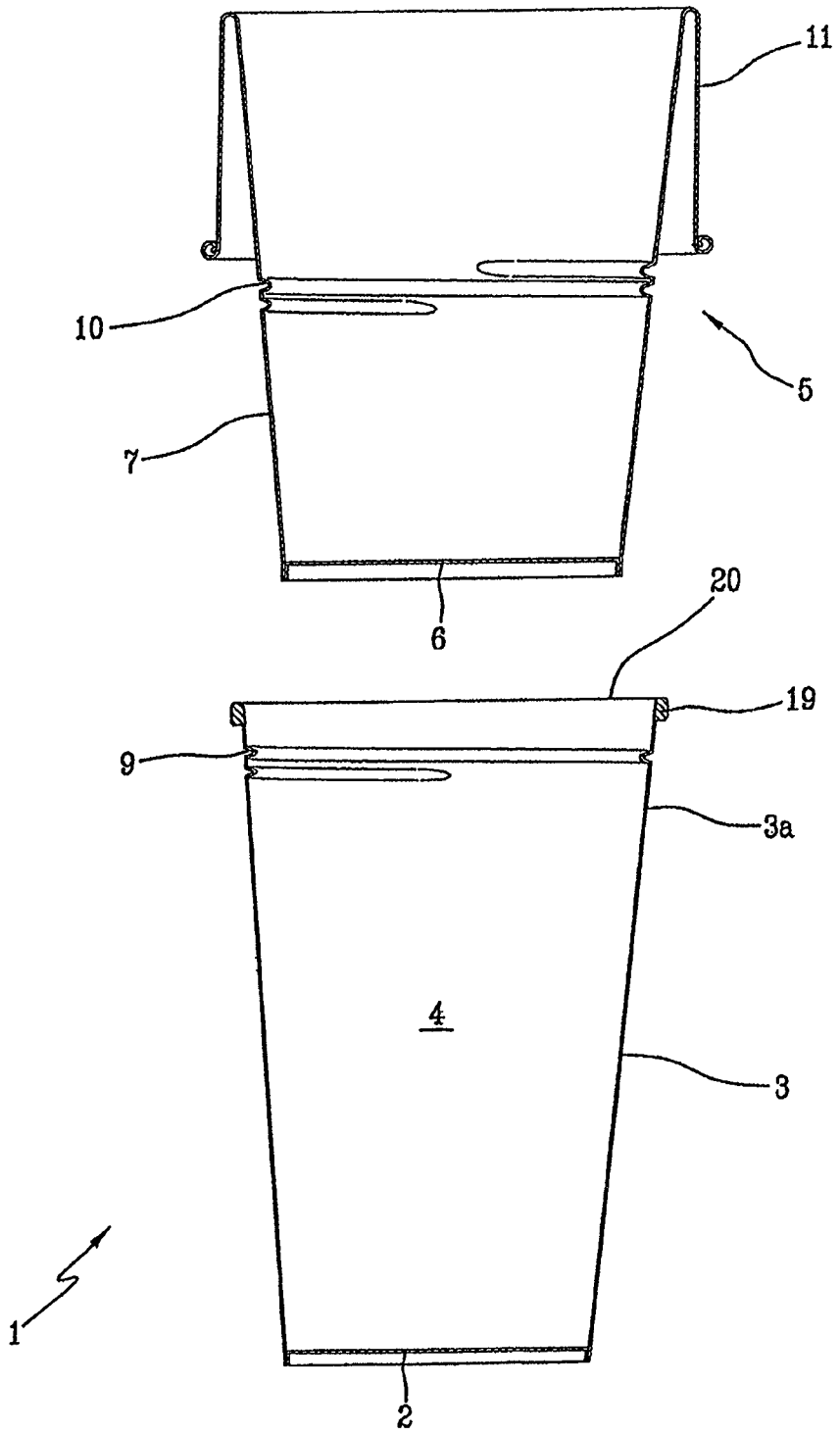
FIGS. 9*a* and 9*b* show the coupling of two containers, one of which defines the closing element.
Figure 9B:
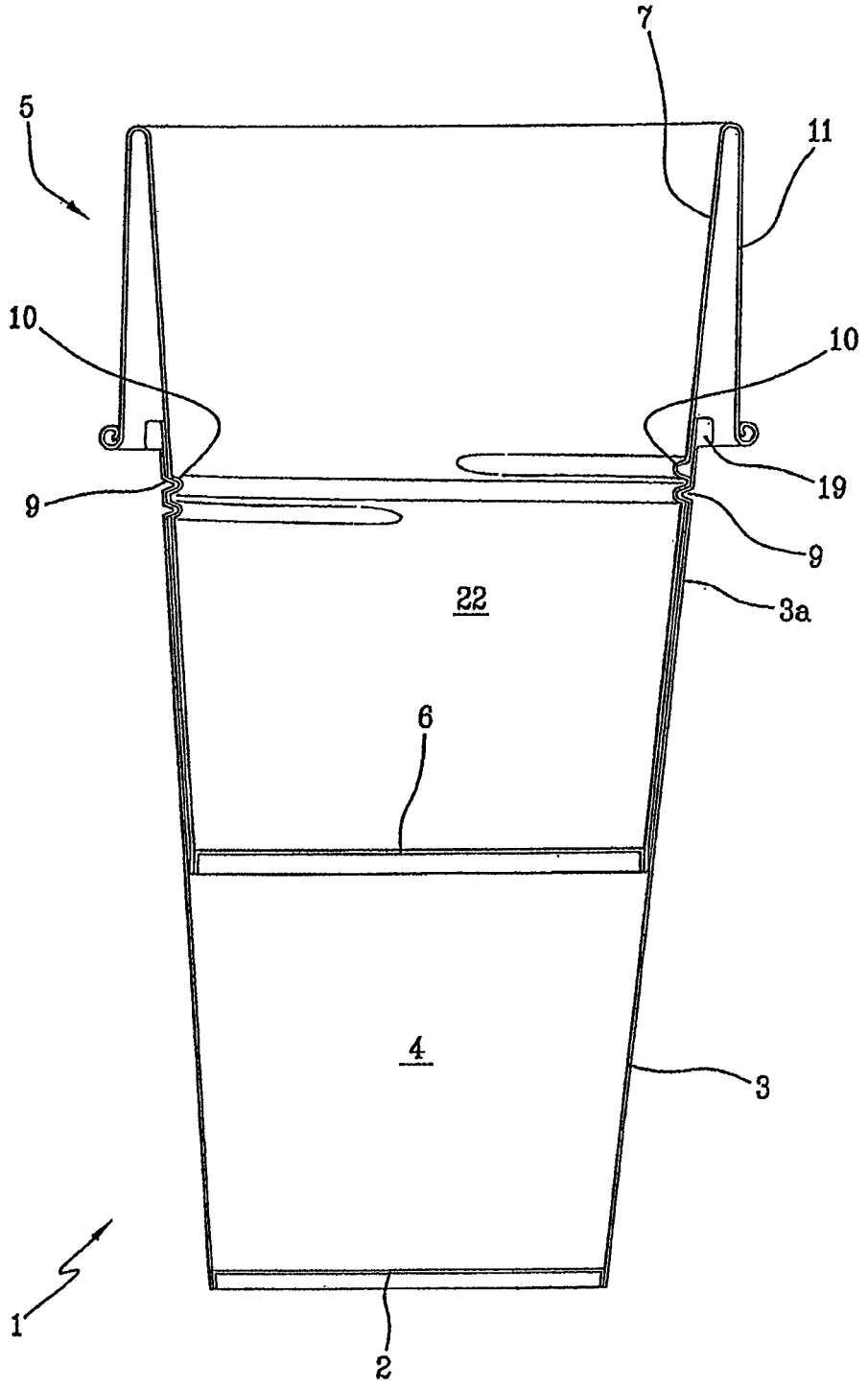
Figure 9C:
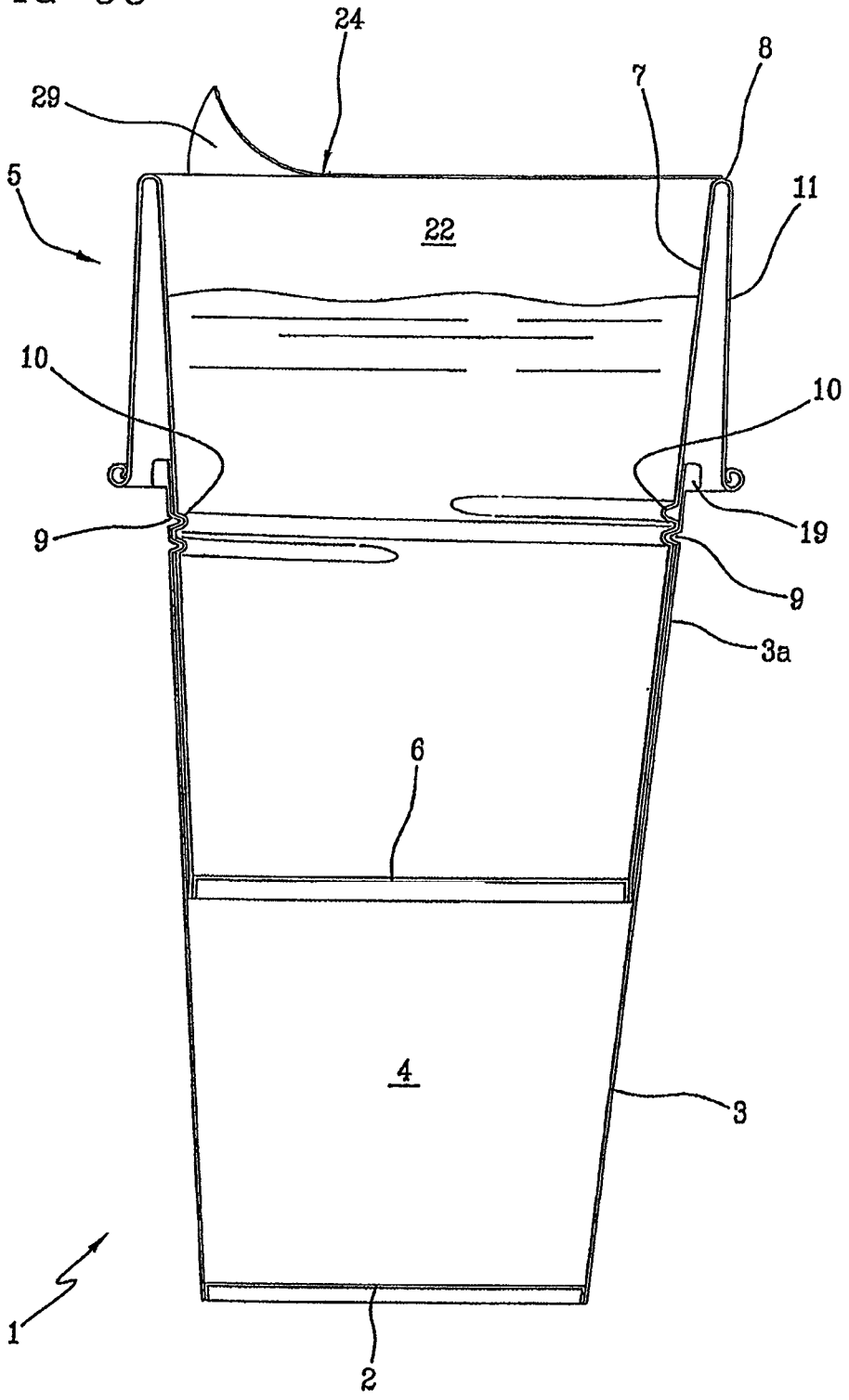
FIG. 9*c* shows a variant of the coupled containers FIGS. 9*a* and 9*b;*

In addition, the closing element 5 can be made from a single flat sheet of paper material appropriately deformed and deep-drawn (FIGS. 1, 2, 2*a*, 8, 10, 12) or, alternatively, be composed of several pieces joined to one another (FIGS. 9*a*, 9*b* and 9*c*).

Moreover, making the closing element 5 of extensible paper enables obtaining contact surfaces with the container that are substantially flat and, if possible, without any pleating or excess of material which are normally generated, deforming a flat element made of paper material, realised starting from common paper.

The presence of substantially flat surfaces, the absence of pleats due to excess of material, can contribute to increasing the seal of the covering element coupled to the container 1, for example, the seal against oxygen and liquids.

Further, an improved seal can be realised, obtaining an additional seal by spraying on the desired surface (for example on the closing element) of a substance which, once solidified the appropriate (and possibly heat-treated) significantly increases resistance to external liquids and agents.

For example, this substance could be applied so as in use to be interposed between the closing element 5 and the free edge 20 of the container, ensuring the seal around the whole circular perimeter.

Note also that the upper portion 3*a* of the lateral wall 3 of the container exhibits a suitable spiral groove 9 aimed at defining a path that extends over a little less than two turns (obviously shorter or longer paths can also be defined without forsaking the inventive concept of the present invention).

Correspondingly the closing element 5 exhibits a groove 10 which is also likely to perfectly marry the above-mentioned groove 9 of the upper portion 3*a* of the lateral wall 3.

This groove 10 is defined at the closing element 7 of the lateral wall 5 in such a way as to enable a rotating coupling of the container to the closing element.

In this way, if the grooves are sufficiently developed, a screw-coupling is defined for screwing the closing element 5 on the container.

In particular, the spiral arrangement of the ribs is such that, in certain embodiments, with the coupling achieved, the folded edge 8 of the closing element 5 goes to abut against the free upper surface 20 of the lateral wall 3.

The locking force is such as to enable a good pull on the above-cited surfaces, such as to be able to guarantee seal of the container during the closing step.

Note however that the film made of plastic material for cladding the container and cover will be in contact at the free upper surface 20, contributing to increasing the fluid seal of the container.

The spiral grooves 9, 10 have very small inclination with respect to the vertical, so as to define an optimal locking force (merely by way of example, the angle of inclination of the spiral with respect to the vertical will be between 1 and 15 degrees).

Figure 2:
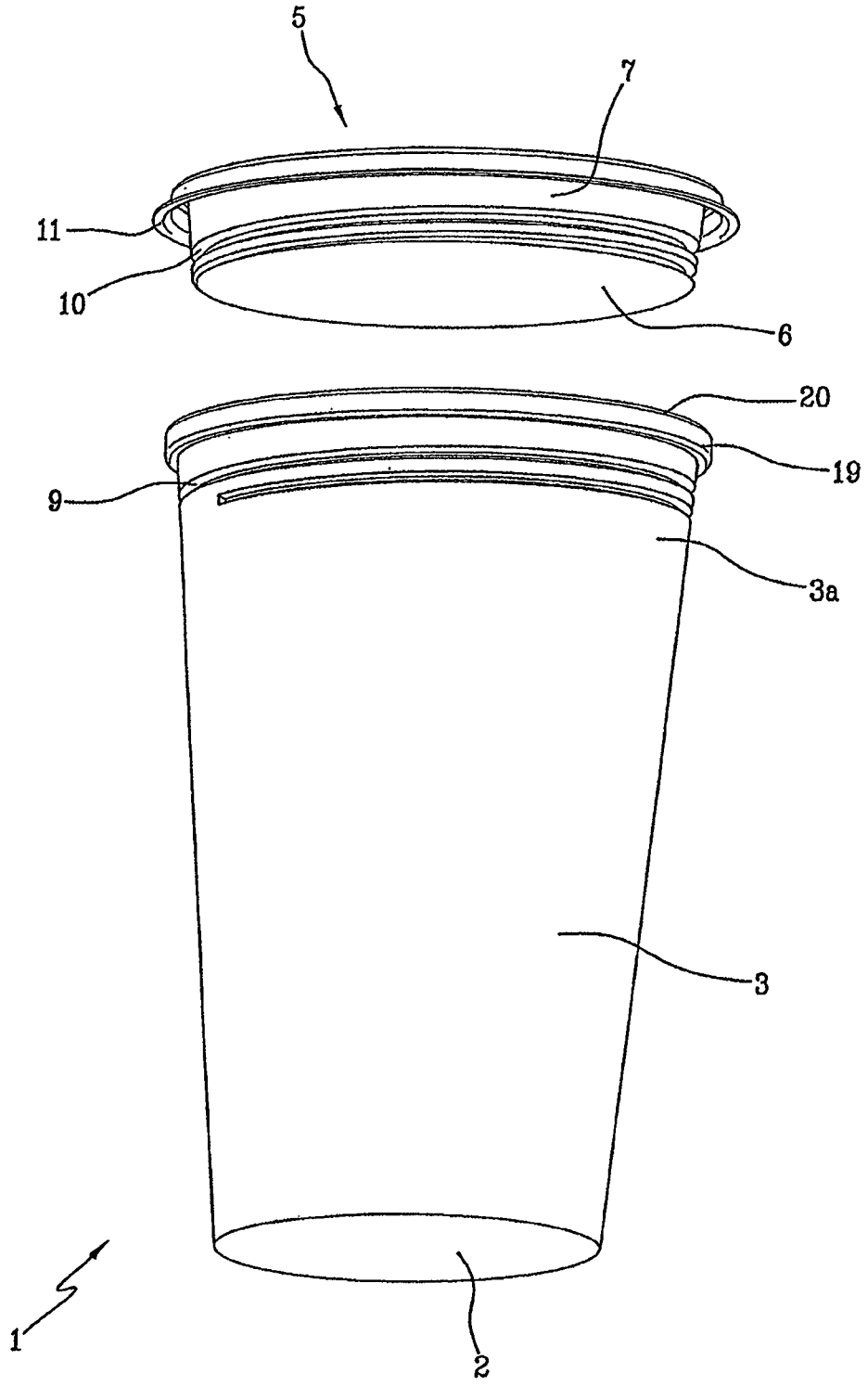

In the first embodiment, shown in FIGS. 1 and 2, the folded edge 8 of the locking element 5 has a portion 11 which extends downwards such as to cover the reinforcing curl 19 of the container, thus contributing to improving the aesthetic appearance thereof.

FIG. 8 shows a further possible variant of a container obtainable with the method according to the invention which shows the potential provided by the use of extensible paper.

The container 1 represented herein in general has a section along a horizontal circular plane of progression, though, while being made of paper, can exhibit broadenings or recesses, for example in the median zone of the containing volume, which would be impossible to obtain with normal papers.

The example exhibits an anatomic profiling 31 for receiving the fingers of a user; obviously, other and different profiling is possible.

The appropriate thread locking element 5 is at the access opening, and is coupled, by complementary joining, to the upper cylindrical portion of the lateral wall 3.

The closing element 5 also exhibits a deformed expanded area 21 at the bottom wall 6 defining, for example, a gripping element for facilitating the screwing/unscrewing of the closing element 5.

A further embodiment is also illustrated in FIGS. 9*a* and 9*b* in which a container 1 is shown, for example in a beaker shape, to which a closing element 5 is coupled to that is, in fact, defined by a further container.

In particular, the locking element 5 is made in two pieces exhibiting a lateral wall 7 and a bottom 6 coupled by heat sealing.

In addition, the closing element 5 presents a folded edge 1 which as well as having aesthetic functions as mentioned above, also has an important function of insulating any contents contained in the closing element 5 so that it is possible to exploit it for consumption of hot beverages or the like.

In particular, FIG. 9*b* shows the container of FIG. 9*a* in conditions of reciprocal coupling.

Figure 10:
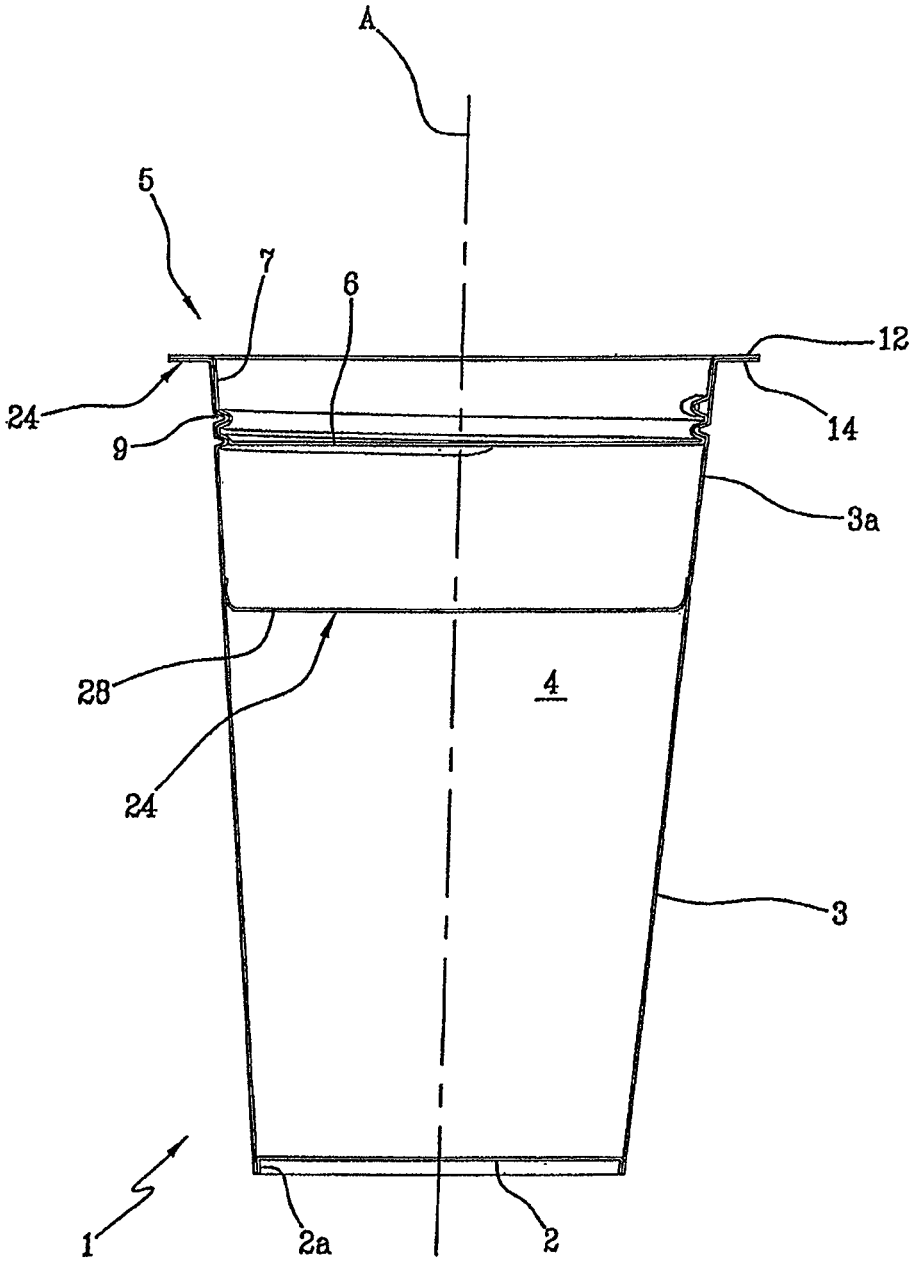
FIGS. 10, 10*a*, 10*b*, 11, 12*a* and 12*b* illustrate further variants of the container obtained in accordance with aspects of the invention.

As can be seen, in this situation a housing compartment 4 is defined internally of the container 1, close by the closing element, but a further containing volume 22 can also be noted (present in any case, even though smaller even in other embodiments, for example FIGS. 1 and 10) defined by the closing element 5.

In the embodiment shown in FIG. 9*c*, the volume 22 defined between the lateral wall 7 and the base 6 of the closing element 5 is used to contain an additional product (e.g. a liquid as shown), possibly different from the one contained in the compartment 4 of the container 1.

Note also the presence of a sealing element 29 defined by a closing film applied on the element 5 (and later separable there-from) in order to create a seal against external agents also for the containment volume 22 in the closing element 5. In this way containers can be realised which can accommodate two different products, one in the main compartment 4, the other in the volume 22 of the closure element 5. By way of example, the containing compartment 4 can house a suitable paint, while the compartment in the closing element 5 can accommodate a second component to be mixed at the appropriate time (two-component food or non-food, medicine).

Figure 2A:
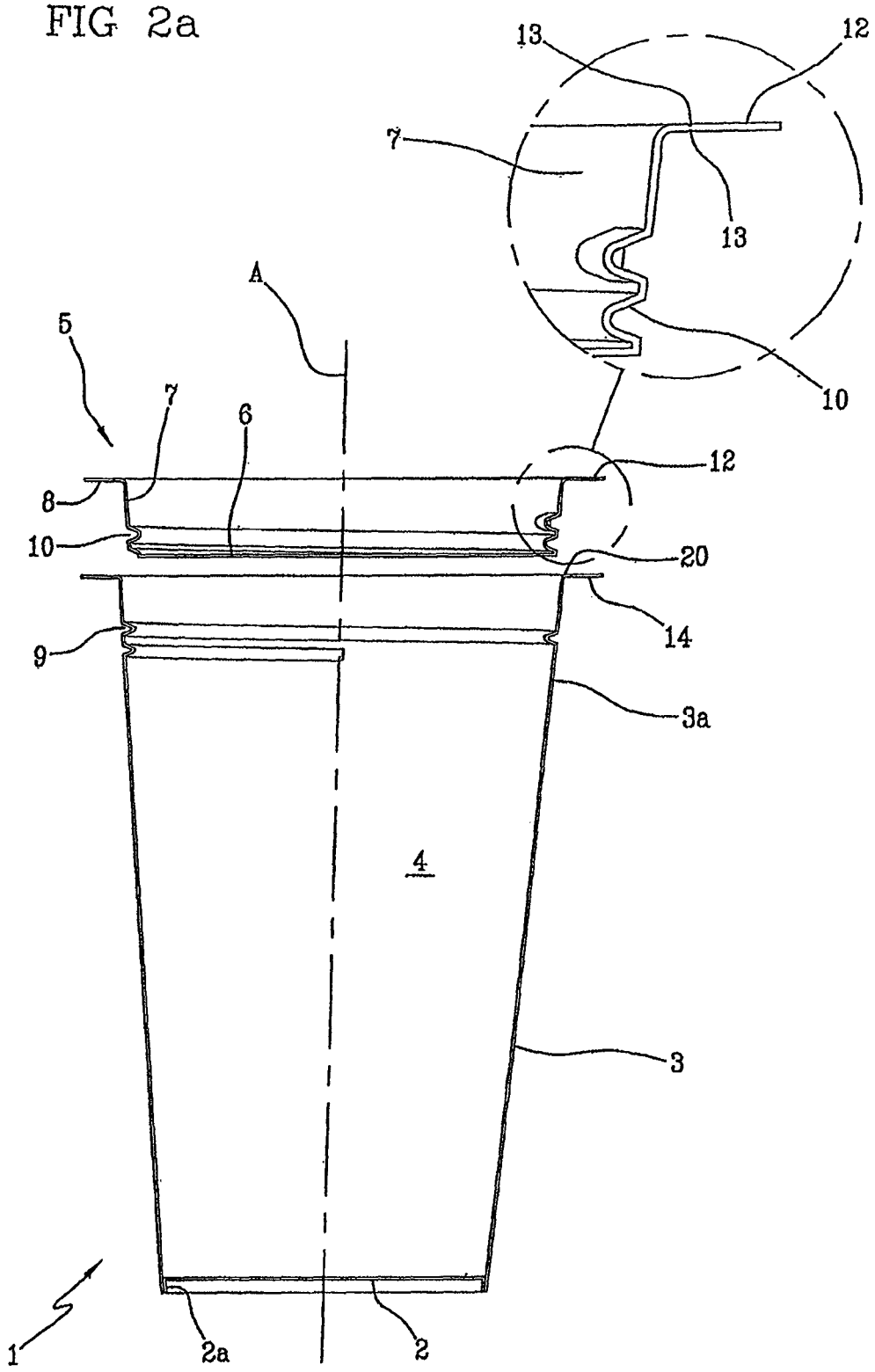
FIG. 2*a* is a section showing a possible variant of the container of FIGS. 1 and 2.

The embodiment shown in FIG. 2*a* is differentiated from the other embodiments in that the curled edge 8 of the closing element has an end portion 12 such as to define a flat circular surface (inclined or not with respect to the horizontal).

At the upper edge of the lateral wall 3 the container 1 also presents a curled edge 14 with the curl towards the outside and arranged in the closed position of the closing element 5 at the above-mentioned flat edge 12.

In this way the two facing surfaces of those portions of the edge 12, 14 substantially touch and can be suitably welded (at one or more points) together defining, when fully joined, a sealed closed condition of the assembly.

Another sealing possibility when both circumferential edges 12 and 14 of the container cap are associated could be the application of a plastic ring (which might be applied during realisation by injection moulding) which would then have to be removed when opening the package.

It is clear that the presence of the sealing layer (polythene or otherwise), coupled to the paper or extensible paper, guarantees that it can contain liquid or the like, as well as enabling the welding one or more parts of container and cap to one another.

Weakened lines 13 can be advantageously provided, on both one and the other (or both, as shown) of the surfaces of the flat portions, previously defined, in particular in a zone close to the upper edge of the container in such a way as to allow a facilitated opening of the container.

FIG. 10 shows a further variant in accordance with the invention in which the container 1 is provided with a suitable sealing element 28 which is applied internally to the lateral wall 3 such as to insulate and seal the container compartment 4 (or at least its lower portion).

Operating in this way, the product contained within the compartment 4 cannot escape from it, or the outside air penetrate it so as to ensure optimal conservation of the product.

Note also that, as in the case of FIG. 2*a*, an additional seal can be provided between the flat portions 12, 14 should a further product be contained in the upper sealing portion 28 (for example a free gift or treat).

Figure 10A:
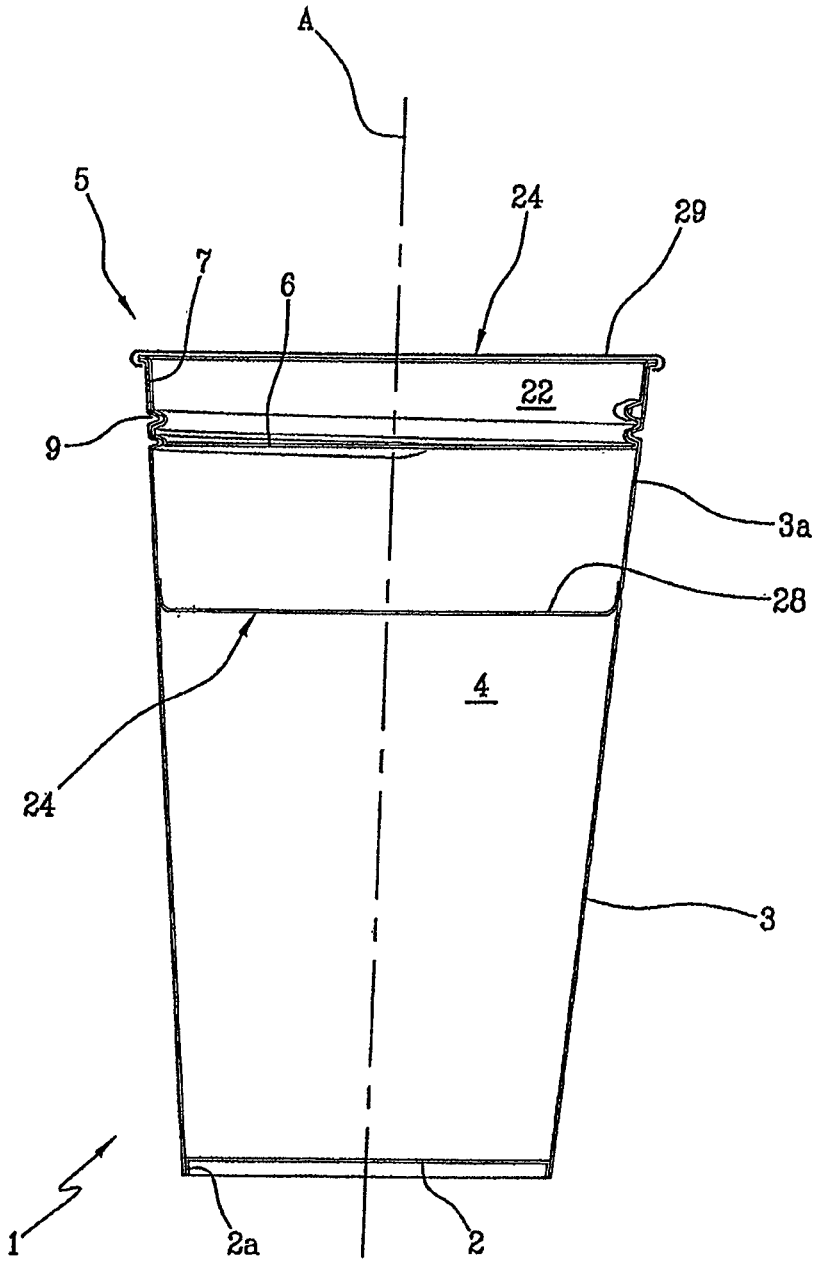

The embodiment of FIG. 10*a* alternatively shows adoption of a sealing element 29 for the closing element 5 which used a heat-retractable plastic film which defines excellent closure of the compartment, possibly also a closure that is sealed against fluid.

A further noteworthy point is that it is possible not only to realise an unremovable coupling with heat-retractable elements, but it will also be possible to define couplings (that while guaranteeing optimal sealing to outside air and therefore to oxygen) which can be separated by simple peeling, and not by tearing of the entire portion 29 (such as for example in FIG. 9*c*).

Operating in this way a perfect seal can be guaranteed against agents external of the container 1 plus closing element 5 system, enabling, once the circular band or film is permanently removed, the container to be opened and closed using the threaded element which engages on the corresponding thread on the lateral wall of the container. In this way the container can be sold with guarantee of sterility/conservation of the product contained therein; and the user can continue to use the container by opening/closing it.

Figure 10B:
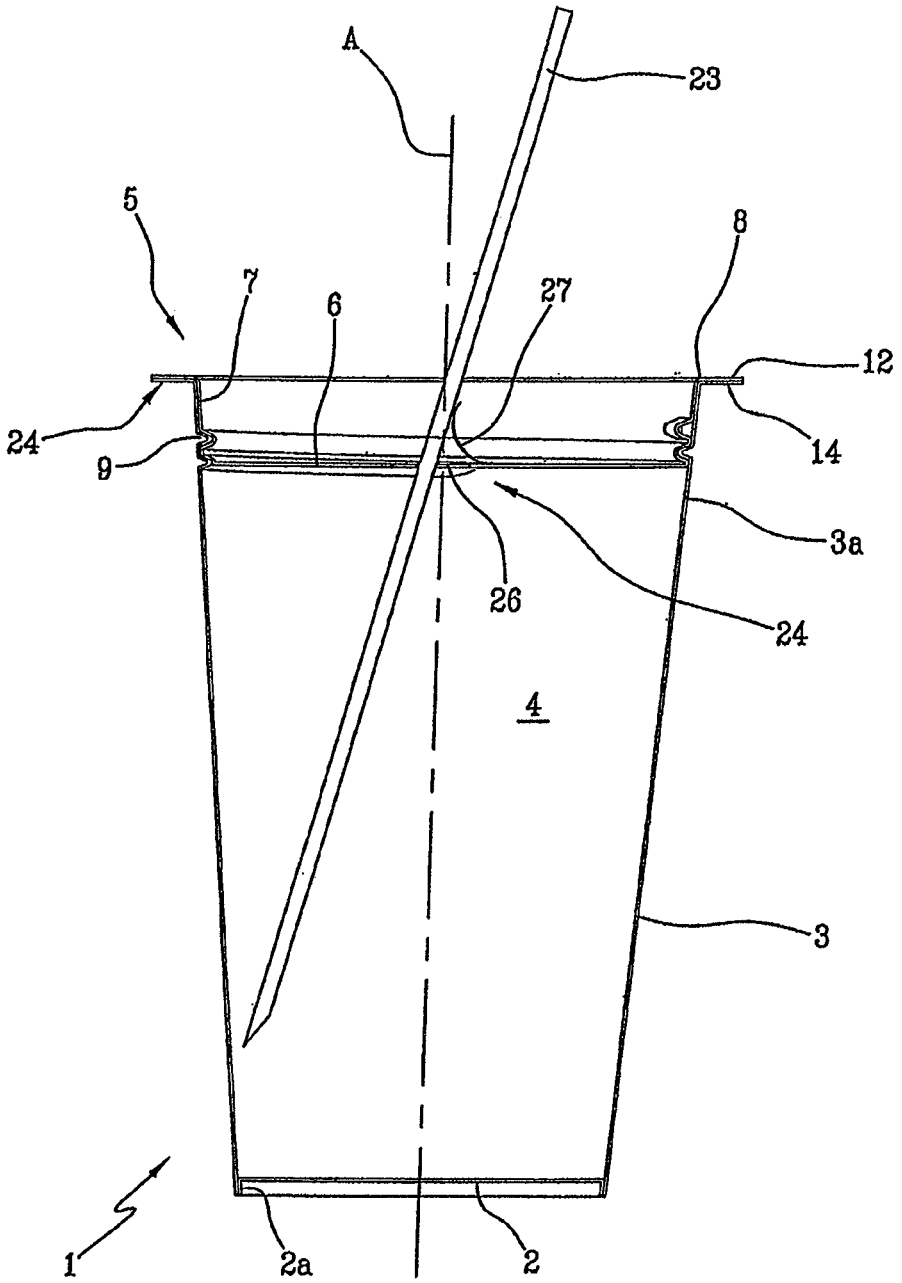

In this case it is clear that, though not necessary, the use of a extensible paper enable an easier and better sealing of surfaces that can be substantially flat though being fashioned by deforming, drawing, compressed air, vacuum, or a combination thereof. The embodiment of FIG. 10*b* shows a further variant of a container structure in which the closing element 5 exhibits, at the bottom wall 6, an access 26 appropriately closed and sealed by a respective sealing body 27, such as a plastic or aluminium film appropriately coupled such as to close the access 26. After removing the sealing body 27 a passage is defined between the external environment and the containing chamber 4 through which, for example, a drinking straw 23 can be inserted, or another device.

In a further embodiment, not shown, the access 26 may be defined by a plurality of holes and be closed with the sealing body 27.

Once the sealing body has been removed, a product in granule form contained in the compartment housing 4 (salt, oregano, seasoning or other item) can be accessed and used.

Figure 11:
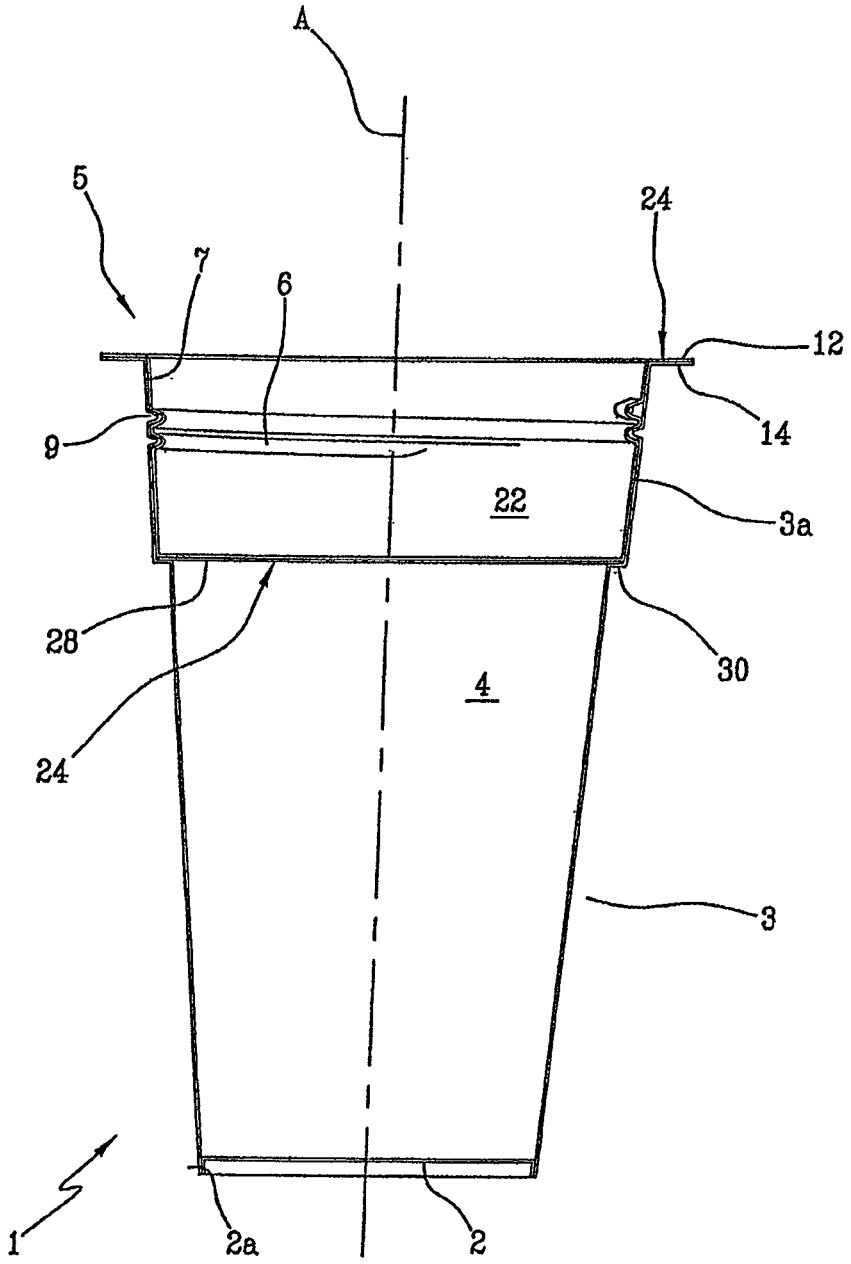

The embodiment of FIG. 11 illustrates an embodiment that is advantageous due to the association of the sealing element 28 internally of the lateral wall 3.

In fact, the container 1 shown therein, when made using extensible paper, can be deformed so as to provide a suitable annular abutting surface 30 which can enable an easier coupling of the sealing film 28.

In particular, the sealing element 28 is applied, for example by means of a punch, and will guarantee the seal exactly at the above-mentioned portion of the annular abutting surface 30.

Note that the abutting surface 30 can constitute the bottom of the closing element 5 such as to avoid the need for screwing operations beyond the end run of the threads. Obviously the volume 22 can be closed with one or more of the above-described methods.

Lastly, FIGS. 12*a* and 12*b* illustrate two slightly different variants to the one previously described.

In fact, the container of FIG. 12*a* is constituted by a tubular structure 1, substantially cylindrical, in which the lateral wall 3 exhibits a double access at an upper portion and a lower portion.

The one, the other or both of the accesses can be suitably closed by duly threaded closing elements 5.

In particular, the example of FIG. 12*a* shows a closing element 5, which in fact defines the bottom 2 of the container.

Note also that the closing element 7 of the lateral wall 5 is arranged, in terms of use of the container, externally of the lateral wall 3.

FIG. 12*b* shows a container 1 equipped with two closing elements 5, for closing both accesses to the compartment 4.

In this case too, the lateral wall 7 of both closing elements 5 is arranged externally of the lateral wall 3.

Note however that the container of FIG. 12*b* can be realised with one, the other or both closing elements exhibiting the lateral wall 7 thereof arranged internally of the containing compartment 4 and the lateral wall 3 (as in the case of FIG. 1).

Note also that in a further embodiment (not shown) with the threaded defined in the lower edge, the truncoconical structure can be drawn, oppositely to its conicity, at the lower zone (obviously this can only be realised with the use of extensible paper) and a beaker can be constructed, for example, with a upturned-conical pedestal, creating a much stabler cup.

Still from the structural point of view, both the thread 9 fashioned on the upper portion of the container, and the thread 10 realised on the closing element, are defined by suitable recesses which face towards the inside of the container, i.e. towards the inside of the lateral wall 7 of the closing element (facing towards the axis A of the container).

In other words, compared to the undeformed condition of the lateral wall 3, or the lateral wall 7, the threads 9, 10 emerge towards the inside of the containing chamber 4, i.e. towards the inside of the circular base of the closing element 5. Also, the ribs/deformations that define each of the threads, on both the closing element 5 and the lateral wall 3, are continuous, i.e. they do not exhibit interruptions in the three-dimensional extension thereof. In some embodiments, which are not illustrated, a rotation coupling can be provided, of the bayonet type, between the container and the closing element.

In relation to the above, FIGS. from 3 to 7 illustrate the various operating configurations of an apparatus for controlled deformation of the container 1 and the closing element 5 with the aim of realising the threading operations on these components. Looking at the figures, for example, FIG. 7, note the presence of a containing structure 102 (optional) which defines internally thereof a housing seating 101 for the container 1. In particular, the containing structure will be substantially complementarily profiled with respect to the lateral wall 3 and the base 2 of the container, and will restingly receive it during the construction steps.

By way of example, the container could be retained therein by means of a vacuum applied at the bottom of the container itself.

Still observing FIG. 7, the containing structure 102 is rigidly constrained to a fixed table 103 having a substantially circular shape, exhibiting a lateral surface 103*a* destined to define a guide for further parts of the apparatus, as will be more fully explained herein below.

The fixed table 103 is supported by a plurality of uprights 104, in turn borne by a support plate 105.

Also present is a moving body 106 which is rested on and supported by the fixed table 103 to which it is further coupled by means of a flange 121 which is guided by the lateral surface 103*a* in such a way that the mobile body 106 can rotate about a central vertical axis of development 108 relative to the fixed table 103.

With the aim of moving the mobile body 106 in rotation, or rather in oscillation about the vertical axis 108, activating means 107 are also provided. The activating means 107, which may be of different nature, are defined in particular in the embodiment illustrated, by a hydraulic or pneumatic actuator 109 which can move an arm 110 to and fro to which a drawing element 111 is suitably hinged, by means of a vertical pivot.

The drawing element 111 has one end tied to the mobile body 106, and the other arm hinged to the arm 110.

Figure 3:
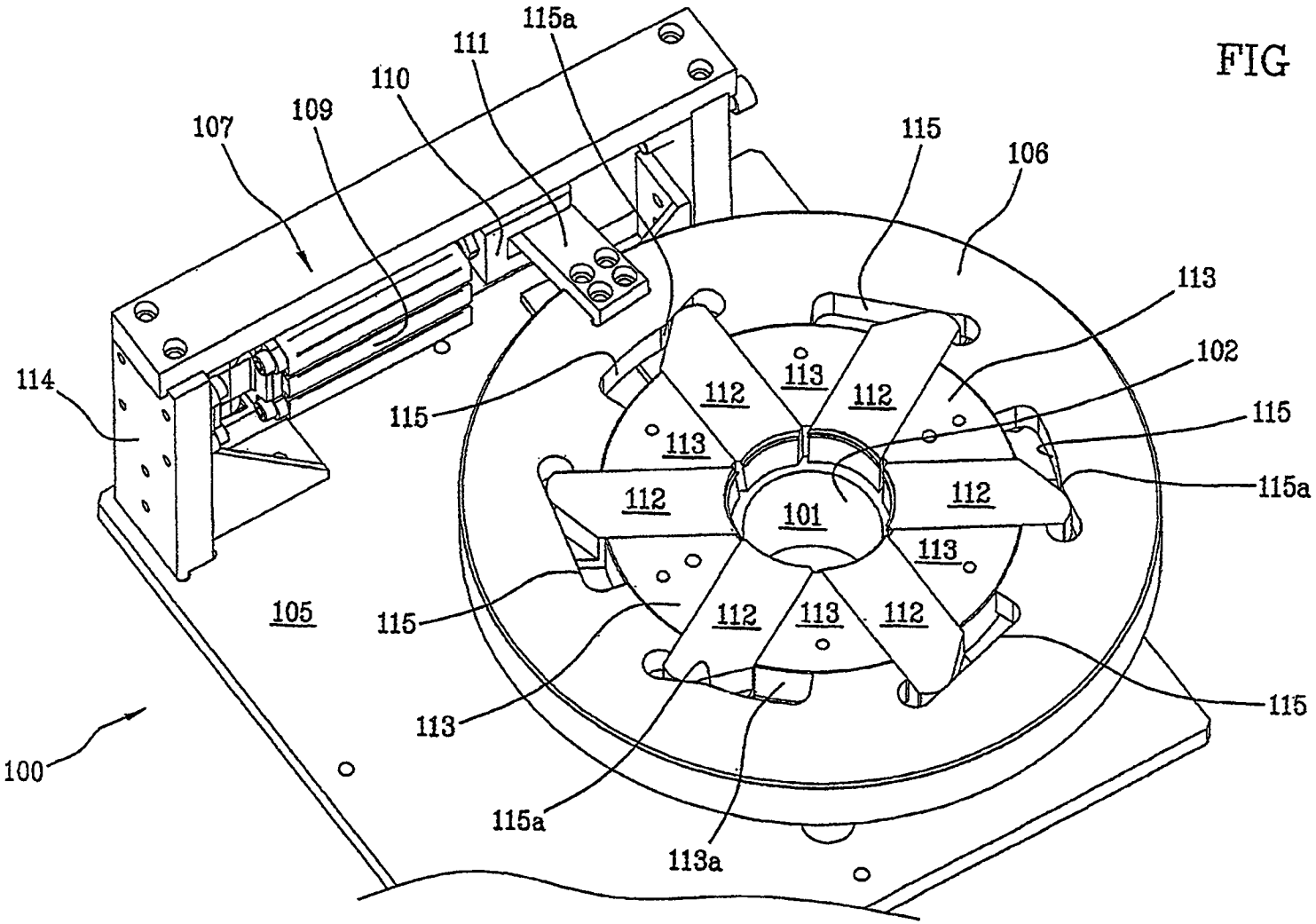
FIGS. 3-5 illustrate schematic views of an equipment suitable for production of the thread on the cap and container, in accordance with the present invention, in different operating configurations.
Figure 4:
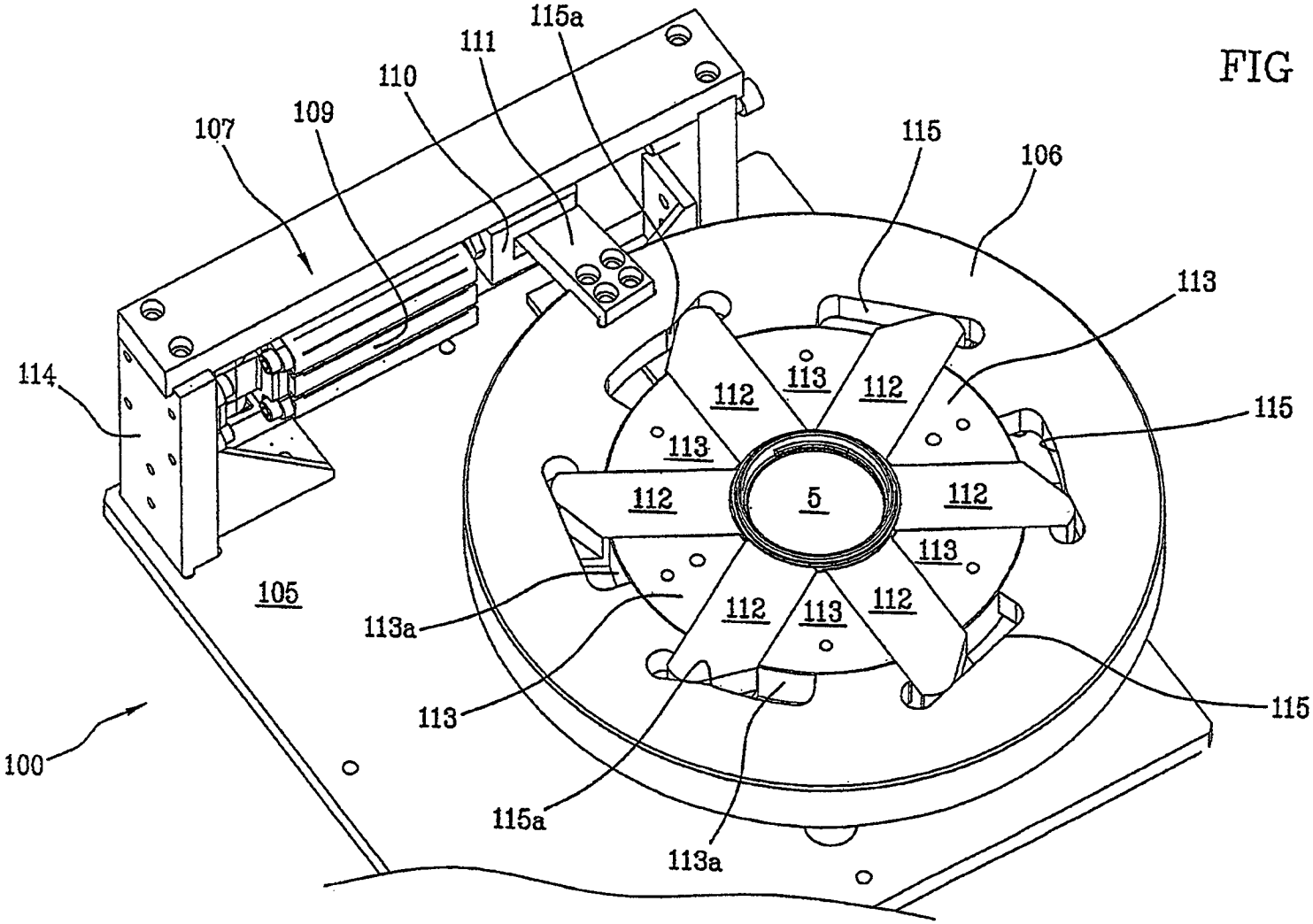

In this way the to-and-fro motion defined by the hydraulic/pneumatic activation 109 is transformed into an oscillatory rotary motion on the mobile body 106. In FIG. 3 we see that the moving body 106 exhibits a central seating having a circular profile and a plurality of grooved guides 115, suitably profiled. A plurality of mobile deforming organs 112 are present internally of the central seating, among which a plurality of fixed circular sectors 113 are interposed.

The coupling between the mobile organs 112 and the circular sectors 113 is such that the mobile organs maintain a degree of sliding liberty in a radial direction towards the central and vertical axis 108.

As can be observed, an external end of the mobile deforming organs 112 is coupled to the grooved guides, in such a way that a partial rotation of the mobile body 106 in one or the other direction leads to corresponding translations in nearing/distancing directions to the central axis 108 of each of the mobile bodies 112.

It should be noted that the grooved guides 115 have differentiated profiles such as to define times of movement and velocity of movement of the different mobile organs 112. The illustrated embodiment (not limiting) illustrates six mobile organs 112 intervalled by six circular sectors 113.

Three grooved guides 115 (alternated to the other three guides 115) exhibit a profile provided with recessed portions 115*a* in such a way that the rotation of the mobile body 106 involves a translation of the respective mobile organs 112 that in terms of time precedes the mobile bodies 112 inserted and coupled to the grooved guides lacking the recessed portions 115*a*.

In this way, during the gripping operations of the mobile organs 112 to the container, three of them, not contiguous, go into contact with the container before the other three, guaranteeing an optimal closure without interference.

Figure 7:
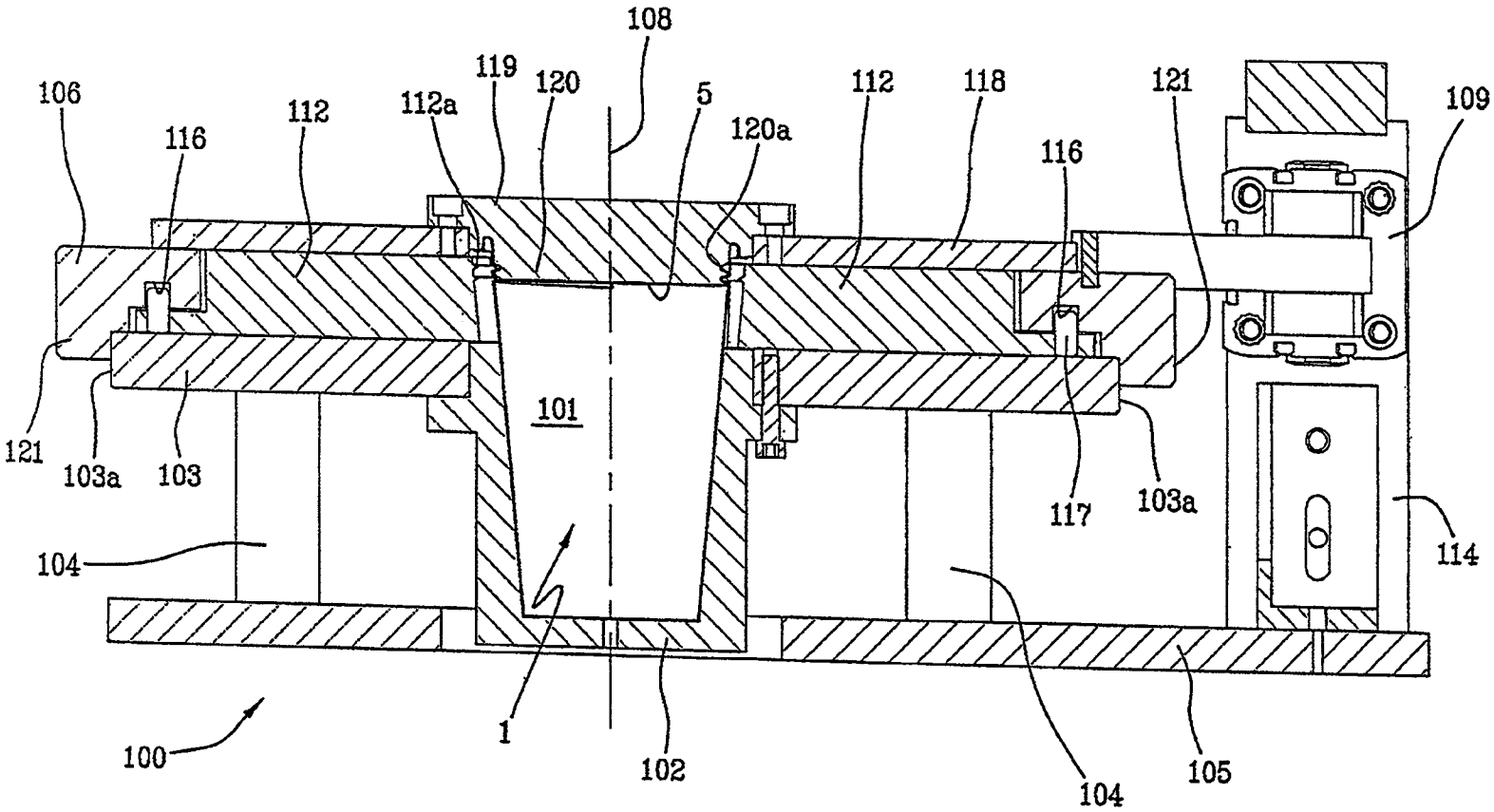

As can be seen in the section of FIG. 7, each of the mobile organs 112, apart from being guided by the guides 115, is also further moved by means of coupling pins 117 coupled to further guides 116.

The above guarantees precise radial to and fro movement of the mobile organs 112 without snagging.

Note also that the represented sections of the equipment illustrate two additional components that were removed from the perspective views in order to simplify understanding of the functioning of the equipment.

In particular, and still observing FIG. 7, an upper plate 118 is present, suitable for packing the structure described above, so as to avoid misalignment of the moving parts (i.e. ensuring their mobility in the horizontal plane).

Further, a counter-die 119 is present, positioned superiorly of the device and coupled to the upper plate.

The counter-plate 119 is positioned at the housing seating of the container 101 such that a profiled portion 120 thereof exhibiting respective gullies 120*a* on the external surface thereof is located (in operating conditions of the device), at least partially inserted in the closing element 5.

In this regard, note that each of the mobile organs 112 has, on its inner end, ribs 112*a* that are substantially complementarily shaped with and predisposed to cooperate with the gullies 120*a*.

Figure 6:
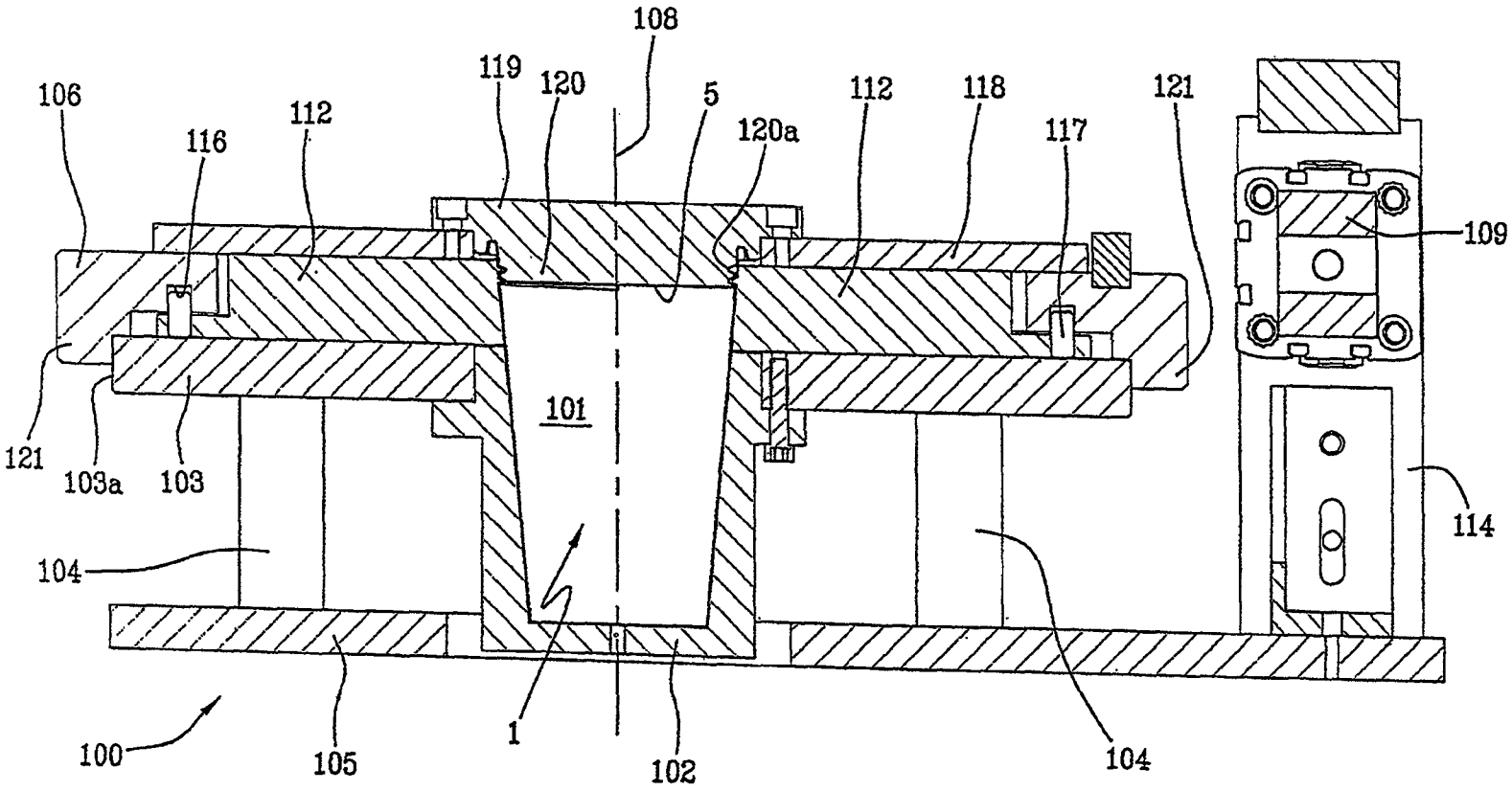
FIGS. 6 and 7 illustrate two sections of the equipment of FIG. 3 in two different operating configurations.
Figure 6A:
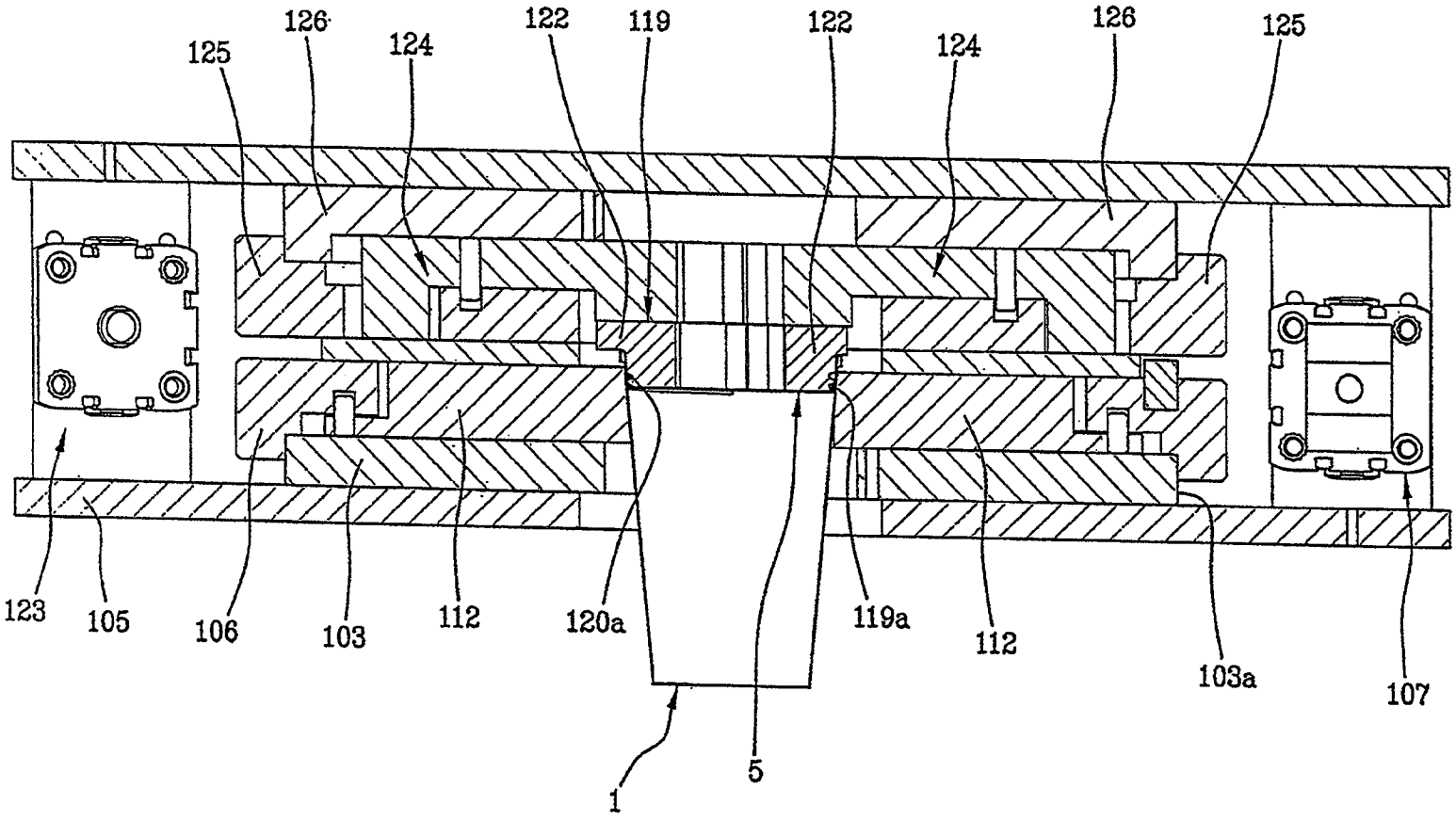
FIGS. 6*a* and 7*a* show two sections of a variant of the equipment of FIG. 3.

A further embodiment of the apparatus for realising the screw-couplings on the container 1 and closing element 5 is shown in the sections of FIG. 6*a* (dies closed) and 7*a* (dies open).

Compared to the equipment shown in FIG. 7, note the presence of a more complex counter-die 119 defined by expandable portions 122 exhibiting the gullies 120*a* destined to cooperate with the ribs 119*a*.

Figure 7A:
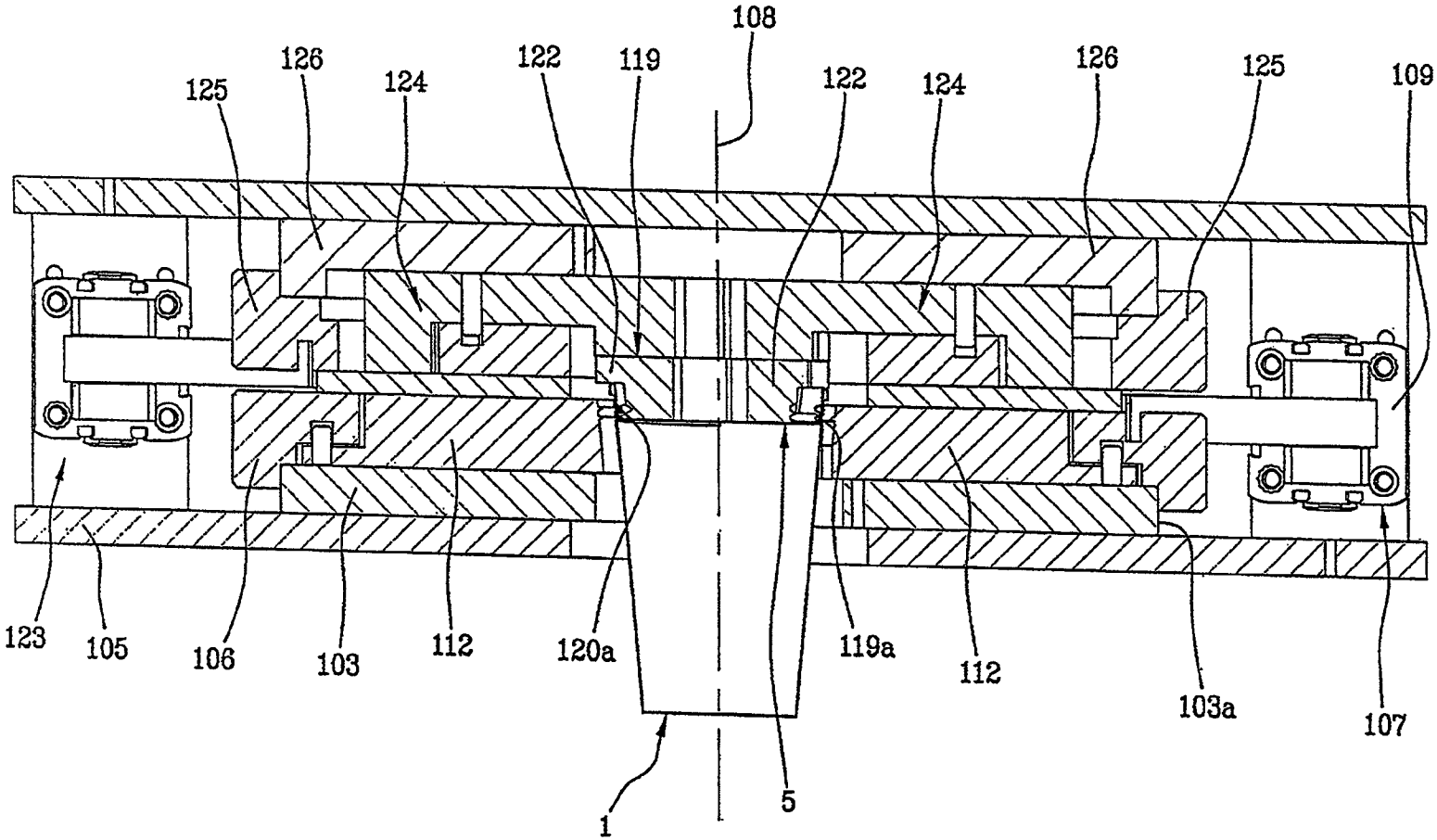

The presence of the above-mentioned expandable sectors 122 is necessary in order to optimise the extraction of the container 1 and the relative closing element 5 once the threading is realised thereon (FIG. 7*a*).

In the rest condition, the sectors 122 of the counter-die 119 exhibiting the gullies 120*a* are retracted towards the central axis 108 of the apparatus and thus do not interfere with the ribs 9, 10 freshly created on the container 1 and on the closing element 5.

In the transition from the rest state to the working state of the device, not only do the mobile organs 112 near the container, deforming the suitable portions thereof, but the expandable internal sectors 122 of the counter-die 199 also come into contact with the internal surface of the closing element 5 such as to be able to cooperate with the corresponding ribs 119*a*, as described herein above.

On conclusion of the operation of deformation, not only will the mobile organs 112 distance from the lateral walls 3, 7, but also the expandable internal portions 122 will retract towards the development axis 108 of the containing structure 102, freeing the thread 9, 10 just realised and enabling a simple extraction.

Conversely in the configuration shown in FIG. 7, the extraction of the counter-die 119 must occur by rotation about the axis 108.

Observing the embodiment illustrated in FIGS. 6*a* and 7*a* in detail, note first the absence of a containing structure 102, which embraces the entire container (as in FIG. 7).

Also provided are additional activating means 123, substantially identical to those previously described, but arranged on the opposite side with respect to the support frame of the machine.

The means 123 move suitable relay organs 124 such as to synchronise the movement of the expandable sectors 122 with the movement of the mobile organs 112, as shown in the sequence between FIGS. 6*a* and 7*a*.

As with the mobile organs, the activating means 123 set in oscillating rotation a disc 125 on a fixed circular body 126. Suitable cam couplings transform the rotary oscillating motion into a movement of radial expansion/retraction of the sectors 122.

This will generate a working position of both the mobile organs 112, and the expandable internal sectors 122, which cooperate and deform the lateral walls of the closing element 5 and of the container 1 (FIG. 6*a*); in a second operating step, the synchronised motion of the movement means 107 and the further movement means 123 moves the mobile organs 112 distancingly from the lateral wall and the expandable sectors 122 also distancingly (but towards the axis 108) from the lateral wall (the condition of FIG. 7*a*).

As can be seen in FIG. 7*a*, the realised closed container can be removed by simple extraction by translation, so that it is not necessary to make any type of relative rotation between the container and the apparatus in order to realise it.

It is clear that other embodiments of the production apparatus are to be considered comprised in the inventive concept of the present invention, even though they are not represented.

For example, the apparatus may include different handling mechanisms such as compressed air and/or gas mechanisms suitable for exploiting the depression such as to obtain the necessary deformations, while however maintaining the same principles of movement.

Following the structural description above, the procedure implemented in accordance with the present invention is as follows.

When the container 1 made of paper material is predisposed, it is positioned in the housing seating 101.

During this stage, the container 1 exhibits a substantially smooth lateral wall 3, free of grooves/ribs or threads.

Also, the closing element 5 is positioned at least partially inserted in the containing chamber 4 such that the lateral wall 7 joins with the corresponding portion of the lateral wall 3 of the container 1.

The closing element 5 also has no rib/groove at the lateral wall 7.

The profiled portion 120 of the counter-die 119 is then inserted internally of the closing element.

In this configuration the apparatus is such that each of the mobile organs 112 exhibiting the ribs 112*a* on the internal end thereof is distanced by a few millimeters from the lateral surface of the container 1 (FIG. 3 where the beaker has been removed for the sake of simplicity).

The profiled portion 120 of the counter-die 119 is also inserted and is substantially complementarily-shaped to the lateral wall 7 of the closing element 5. It should however be noted that the profiled portion exhibits respective gullies 120*a* which, in this configuration, define cavities that are superficially closed by the lateral wall 7 of the closing element 5.

At this point the activating means rotate the mobile body 106.

In this way, each of the mobile organs 112, following the trajectories and times imposed by the respective grooved guides 115, is brought first into contact and then into interference with the lateral wall 3 of the container 1.

When the rotating run defined by the activating means 107 is complete, the apparatus is in the configuration of FIG. 6.

As can be seen, a portion of the lateral wall 7 of the closing element 5 and a portion of the lateral wall 3 of the container 1 are interposed and deformed between each of the ribs 112*a* and the respective gullies 120*a*.

Figure 5:
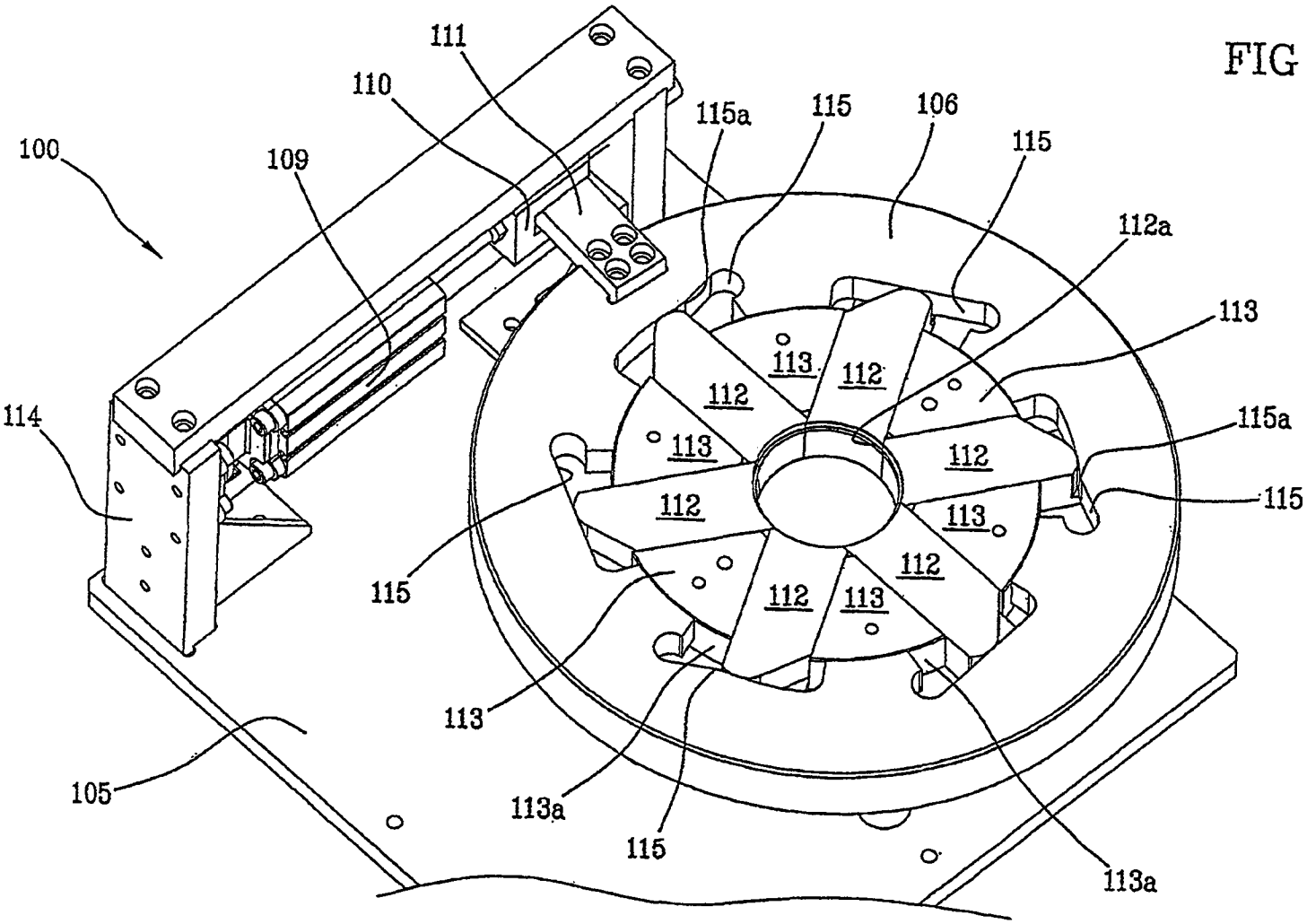

FIG. 5 illustrates the condition of FIG. 6, with the container and counter-die removed in such a way as to illustrate the fact that, in the working position, the mobile organs 112 define, by means of the respective ribs 112*a*, a continuous rib with a helical progression.

The gullies 120*a* also define a same progression, in negative, such that the pressure exerted on the portions of paper material internally of the structures are such as to generate the helical rib on both the container and the closing element, thus defining a threading which extends in general over at least 120° and in particular for more than 360° (and even more preferably over 540° in such a way as to define more than a revolution and a half of helix on the two pieces).

The defined surfaces represent two respective threads, substantially identical in engaged conditions, and the container and the cap of the container can be constrained to one another by a suitable rotation.

In the case of the embodiment of FIGS. 6*a* and 7*a*, with the distancing of the mobile organs 112 there is also a distancing of the expandable sectors 122 such as to free the threaded container.

In this way a removable coupling of the screw type is defined on the container. As an option a further stage of sealing of at least a portion of the closing element 5 can be provided, to at least a corresponding portion of the container 1.

The sealing stage can be performed at the same time as the realising of the threads or even at a later or preceding stage.

For example, observing the container of FIG. 2*a*, it is possible that the flat portion 14 emerging distancingly from the free edge 20 of the container 1 and the corresponding flat portion 12 emerging distancingly from the lateral wall 7 of the closing element 5 are set in contact with one another, defining a reciprocal constraint zone, annular in the present case, by sealing.

In fact, working with appropriate pressures and heating, a partial fusion of the polyolefin plastic film cladding the paper material can be achieved, thus guaranteeing a solid and sterile seal of the two elements.

Also, at least one of the flat portions 12, 14 (and preferably both) exhibit respective weakened lines 13 in order to allow separation of the sealed portions from one another and the container.

The above procedure enables a removal of an external annular closing portion so that access can be gained to the contents.

The removal of permanent closure, however, does not affect the ability to open and then close the cover by turning the closing element 5.

Alternatively, it is possible to realise the further constraint zone between the closing element 5 and the container 1 only at least at a portion of the structure 1 and at least a portion of the closing element 5 (either two or more separate portions).

It is clear that working in this way, a further constraint zone 25 is defined (different from the threaded coupling) which is not hermetically sealed, but has the exclusive function of being anti-tampering.

In other words, once the product is packaged, the user can know whether the container has already been used/opened simply by verifying the integrity of the seals. It is clear that the further constraint zone 25 can be defined at the upper contact perimeter between the free edge 20 of the container of the closing element 5, corresponding to the flat surfaces 12, 14, previously mentioned, or even to other areas of contact between the closing element 5 and the lateral wall 3, for example at the upper zone with the respective portion 11 that extends towards the bottom of the closing element 5.

It is also clear that the presence of a plastic film coupled to paper material can be helpful during the step of realising the sealing (complete or partial).

With reference to figures from 13 to 19 aspects of the invention are below illustrated in accordance with further variants.

Figure 13:
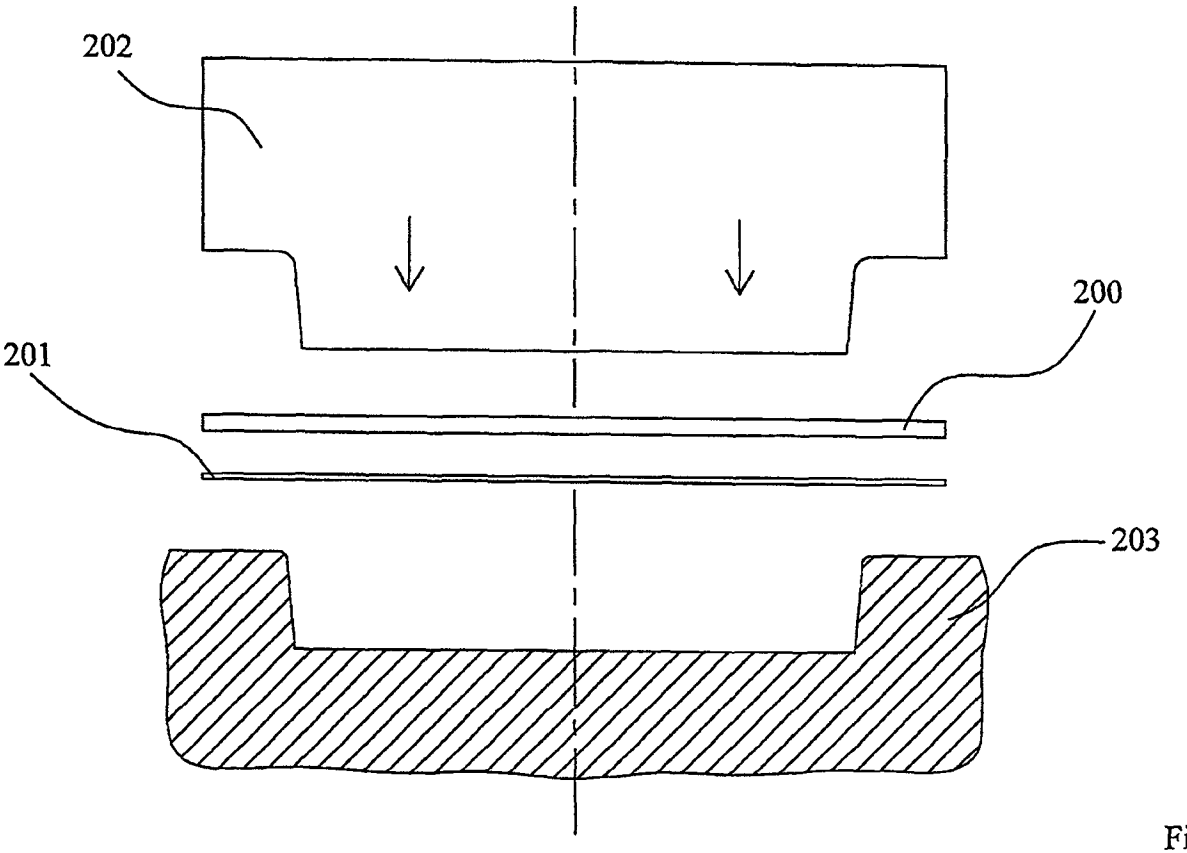
FIGS. 13 to 15 schematically illustrate a method and apparatus for construction of a container and a cap therefor according to a variant of the invention.

FIG. 13 shows a first stage of a process destined to form a container of the type illustrated in FIGS. 15-19. In particular, the procedure involves the preparation (FIG. 13) of a first and a second sheet material 200 and 201. The first sheet material 200 is for example made of a paper material such as paper or cardboard, or paper material treated with a coating film such as a single polyolefin (polyethylene or polypropylene or other) or in a paper material or treated with a film coating such as polyolefin films, aluminium films, or EVOH or other barrier layers. The second sheet material 201 is made of a material capable of ensuring air-tight properties, such as a plastic film, for example a polyolefin film. Alternatively, the second sheet material 201 may have a multilayer structure in which a layer is made of a plastic film (e.g. a polyolefin) and a layer of paper material. In any case, the first and the second sheet materials must be realised in such a way that the interface between the two materials makes them easy to separate, as will be further described below.

Figure 14:
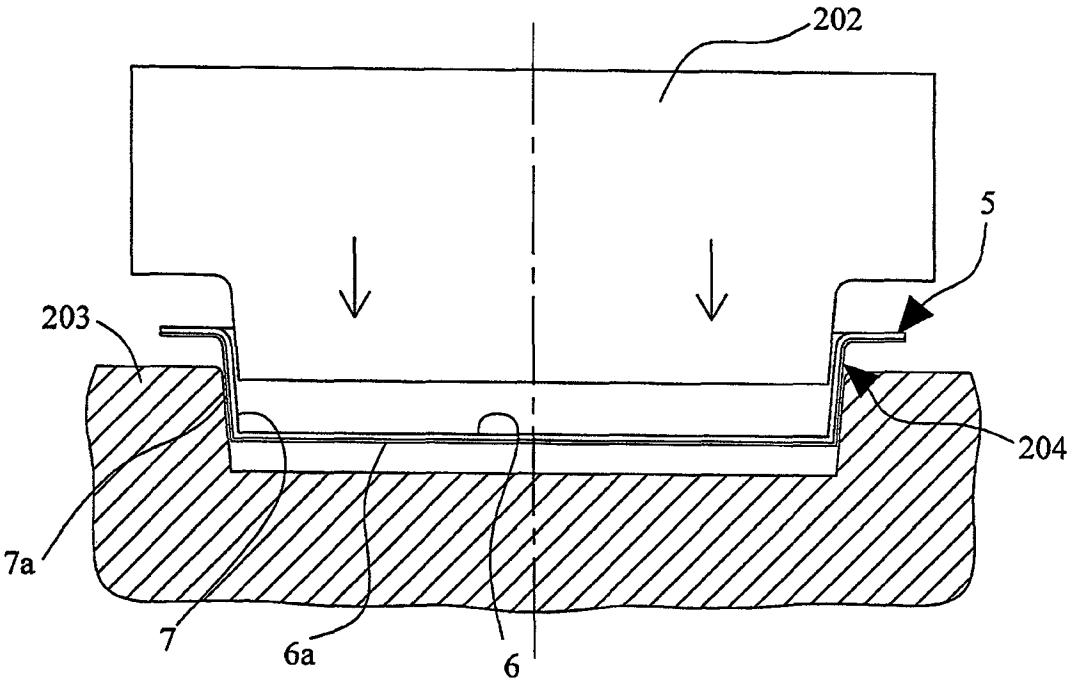

A forming tool 202 cooperating with a counter-tool 203 is moved relatively to the superposed layers 200 and 201 such as to close the layers between the two tools (FIG. 14) and to form a closing element 5 to which a sealing layer 204 is associated. The closing element 5 then exhibits a respective base 6 and a lateral wall 7 made of the first sheet material, both externally coated with a layer 204 made of the second material. The layer 204 includes a respective base portion 6*a* superimposed on and counter-shaped with respect to the base 6, and a lateral portion 7*a* superimposed on and counter-shaped to the side wall 7.

In the examples of FIGS. 15-19, the closing element 5 exhibits a base wall 6 having a substantially circular shape, from which a lateral wall 7 emerges, for example having a truncoconical progression that preferably terminates with an upper curl 8 that is radially directed towards the outside of the lateral wall 7.

Further, the curled edge 8 of the closing element is destined, in use, to abut against the free upper edge 20 of the container, following interposing of the terminal edge 8*a* of the sealing layer 204.

Figure 15:
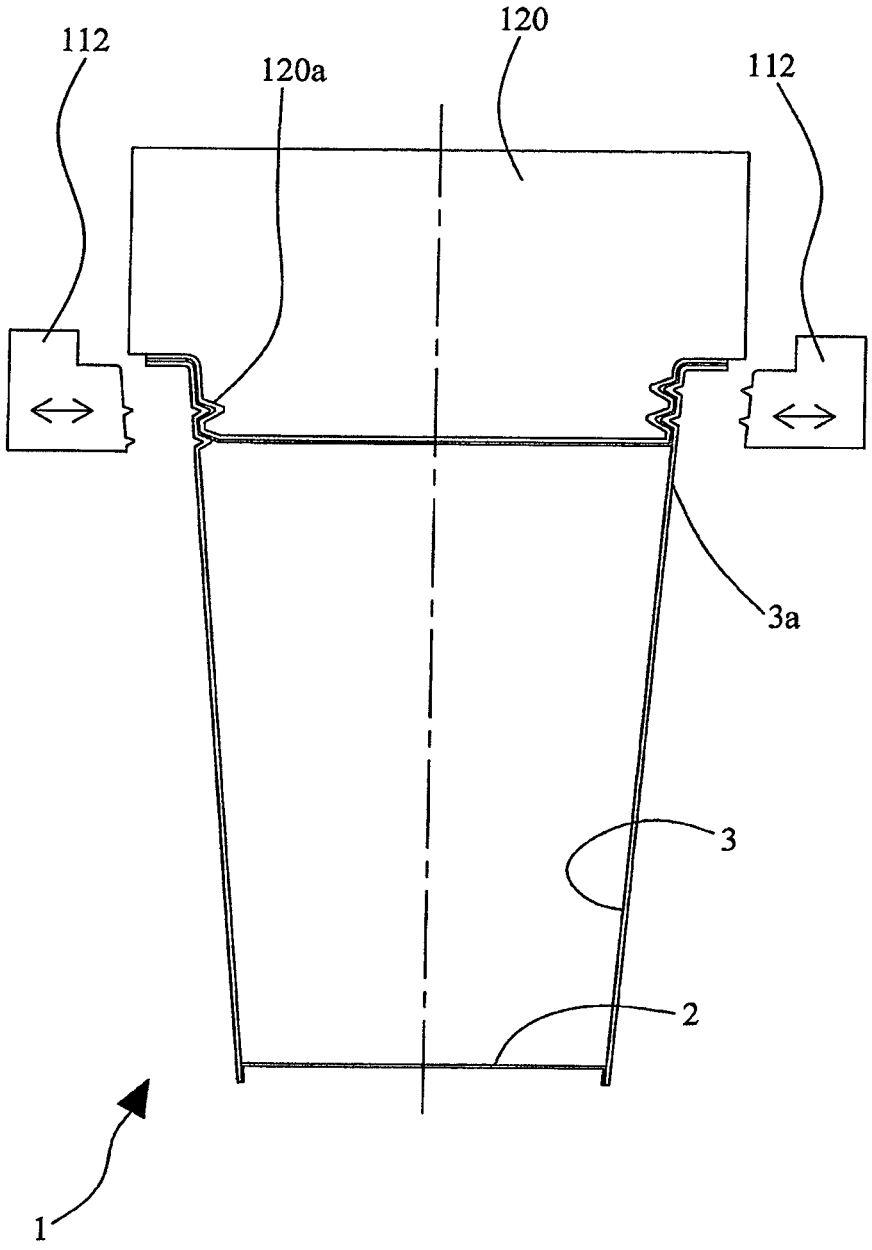
Figure 16:
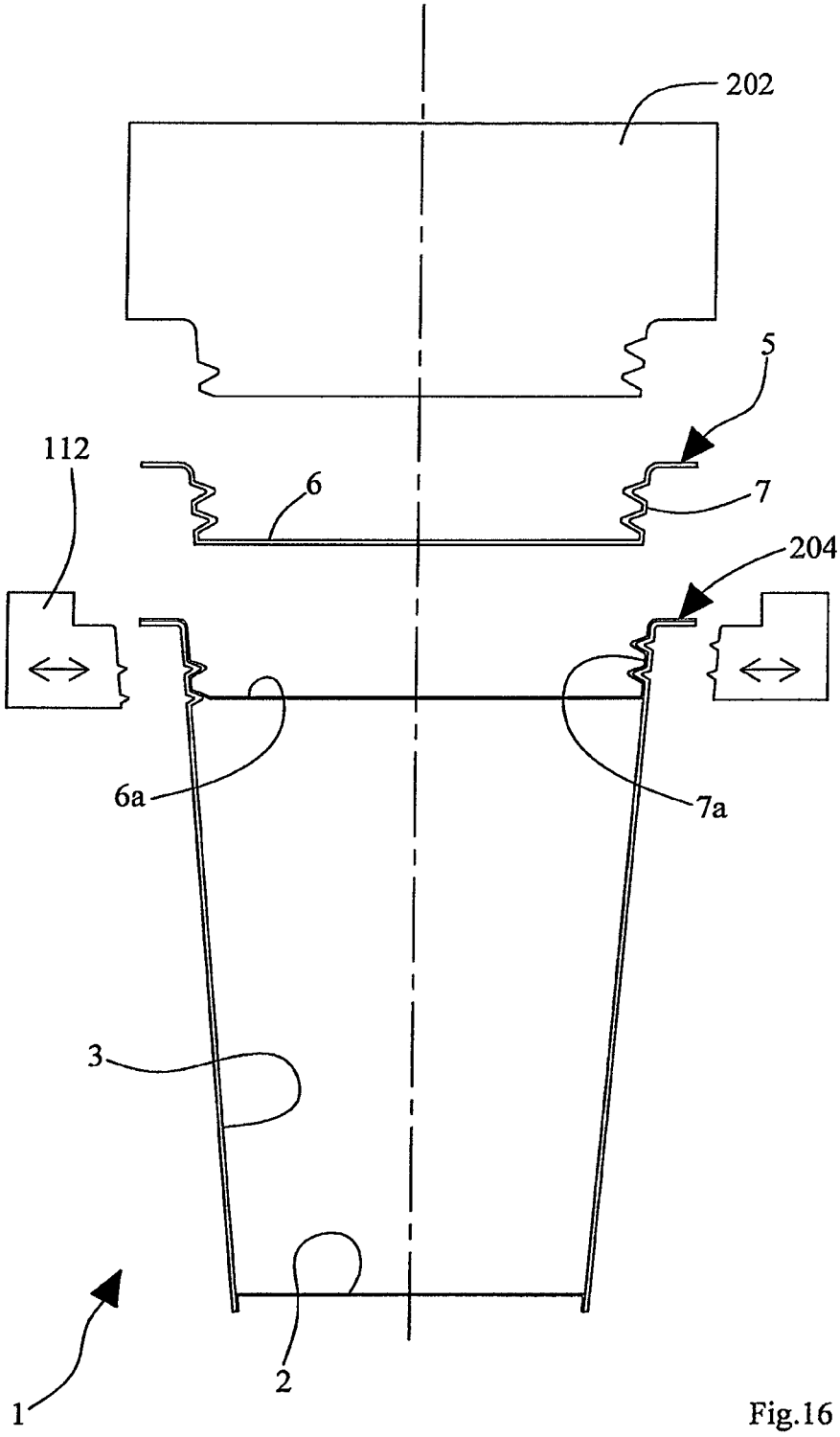
FIG. 16 illustrates a container that can be realised using the method described in FIGS. 13-15 where the cap has been separated from the rest of the container.
Figure 17:
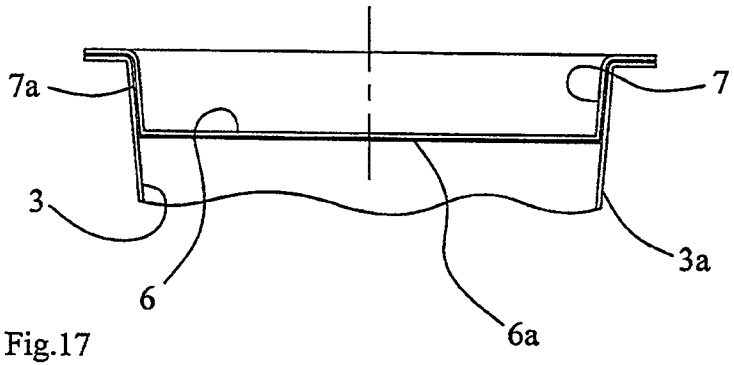
FIGS. 17-19 show three further variants of a container that can be realised with the method illustrated in FIGS. 13-15.

The closing element 5 is then positioned in an apparatus 100 for controlled deformation of the closing element 5 and for coupling to a container 1. For example, the apparatus may be the one illustrated in FIGS. 3-7 (or the variant illustrated in FIGS. 6*a* and 7*a*), which is therefore not newly described in detail. Note, as shown in FIG. 15, that the container 1 may for example be similar to the container of FIGS. 1 and 2 such as to define, in cooperation with the lateral wall 3, a housing compartment 4 for the product to be contained. The container 1 can be made of a paper material internally lined with a film suitable for food use, such as a single polyolefin (polyethylene or polypropylene or other) or it can be laminated with aluminium, EVOH or other barrier layers. The shape of the container, and the fact that it is made from a single sheet of paper material or a plurality thereof appropriately constrained to one another, is entirely by way of example.

Again with reference to FIG. 15, the closing element 5 is associated with the container 1 so as at least partially to close the access: during this stage, the lateral wall 7 of the closing element 7 is positioned at the portion 3*a* of the lateral wall 3 of the container 1 facing towards the inside of the compartment 4. During this stage, the layer 204 has the portion 7*a* interposed between the portion 3*a* of the lateral wall 3 and the lateral wall 5 of the closing element 7. After the association stage, a phase of deformation is expected of at least part of the lateral wall 7 of the closing element and at least a part of the portion 3*a* of wall of the container 1 such as to realise corresponding slots 9, 10 thereon, or at least such as to conform the profile of the lateral wall 7 of the closing element to the profile of the lateral wall 3 of the containing body. During this stage, the lateral portion 7*a* also takes on the same shape as the lateral wall 7 and the portion 3*a* of the wall 3. In practice, as the portion 3*a* of the lateral wall 3 and the lateral wall 7 together with the portion 7*a* are constrained and forced internally of the annular space defined between the tools 202, 203, the walls 7*a*, 7*a*, 3*a*, take on an identical shape. Further, by suitable selecting the material of the various components, the adhesion force per surface unit between the wall 3*a* and the portion 7*a* of the layer 204 can be made to be considerably greater than the adhesion force per surface unit existing between the portion 7*a* of the layer 204 and the lateral wall 7 of the closing element.

In greater detail, the base wall 6 and the lateral wall 7 of the closing element 5 are realised at least of a first material (for example paper material), while the sealing layer 204 is realised in a second material (for example, and non-limitingly, a plastic film, for example made of polyethylene or polythene) that is different to the first material and able to sealingly adhere with the wall 3 of the container 1. For this purpose, the wall 3 can internally bear a film made of a plastic material, chemically compatible with the material of the sealing layer for example once more a polyolefin, for example polyethylene or polythene). In any case the second material used for realising the sealing layer 204, as in the illustrated examples, comprises at least a continuous plastic film extending to close the compartment 4 and able to realise a substantial gas seal. In the examples illustrated in FIGS. 15-19, the sealing layer closes and seals the compartment 4 and, apart from the base portion 6*a* and the lateral portion 7*a*, further comprises also a terminal portion 8*a* that radially diverges externally of the compartment 4, aligned with the lip 20 and located interposing between the container 1 and the closing element 5.

In order to achieve an anchoring and a tight coupling between the stable layer 204 and is the container 1, at least part of the material forming the lateral portion 7*a* of the sealing layer and/or at least part of the material forming the portion 3*a* of the wall 3 comprise a plastic material. During this deformation stage, the temperature near the area of mutual contact between the layer 204 and the portion 3*a* is brought to a level that is high enough to cause localized melting or softening of the plastic material, so that the lateral portion 7*a* sealingly welds to the portion 3*a* of the wall 3.

In turn, the closing element 5—which, as mentioned above can be made of paper, cardboard, paper material laminated to plastic or metal films—exhibits at least a layer of the base wall and the lateral wall intended to be facing towards and in contact with the sealing layer made of a material that is chemically compatible with the second material. For example, the closing element can be entirely made of paper such as easily to disengage from the container 1, without compromising the continuity of the seal given by the layer 204.

Note that during the above-described deformation stage, a part of the portion 3*a* of lateral wall 3 of the container 1 can be profiled, and the corresponding parts of the walls 7 and 7*a* too, such as to define coupling/decoupling surfaces by rotation between the closing element 5 and the container 1.

Figure 19:
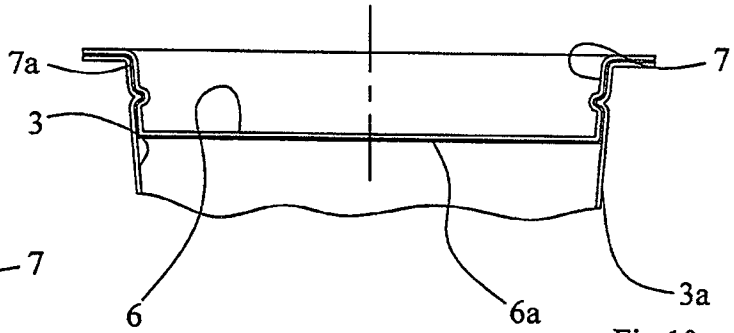
Figure 18:
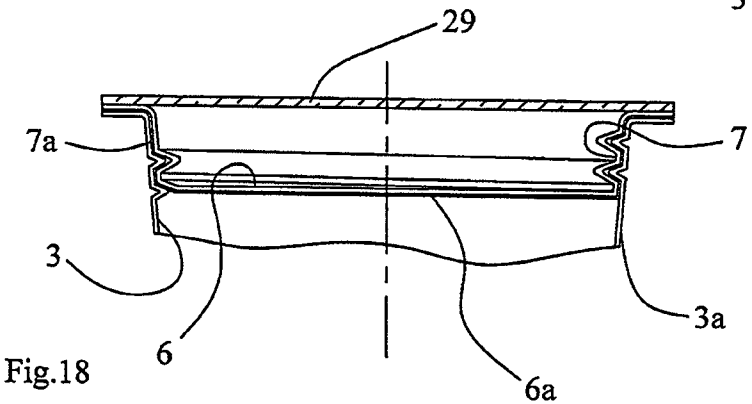

In any case, thanks to the greater bond strength between the layer 204 and the internal surface of the container 1 with respect to the bond strength between the layer 204 and the closing element 5, the closing element 5 can easily be separated from and newly re-coupled to the container 1 without even minimally compromising the continuity of the coupling between the layer 204 and the container 1, even in the presence of surface coupling/decoupling defined by grooves or threads, as shown in the examples of FIGS. 15, 18 and 19.

It should finally be noted that each of the technical characteristics illustrated in the specific examples can be translated to other examples shown in the present application. In other words, the presence of the sealing element 29 shown in FIG. 9*c* can be used in any one of the embodiments illustrated in the other figures, such as the presence of the sealing element 28, or also of the accesses 26 and the corresponding sealing body 27 illustrated only in FIG. 10*d*.

In fact, these technical characteristics have been shown in different specific embodiments only by way of example, and so as not to pack the present description with a plurality of further embodiments combining the technical elements.

Last but not least, it should be stressed that the methodology, the container and the apparatus described can find a specific (by way of example), but advantageous application in machinery for the automatic distribution of products (vending machines). In fact, for example, vending machines (such as coffee or other) are effective completed but can provide, even with selective consumer choice, the presence of a screw-cap closure, as described, on the container.

This enables easier transportation and a more secure handling of the product, also improving hygiene.

An apparatus of the type described (or modified while retaining the inventive essence in order better to be adapted to a housing in the distributor) might automatically position the cover, realising the thread and delivering the product in a closed container ready for use.

Evidently, this application also extends to other products in addition to beverages, such as detergent, sweet foods, beads, small objects, and so on.

The invention therefore offers important advantages.

First, the proposed method enables obtaining a thread and a counter-thread on the cap and container, which are perfectly joined and complementarily-shaped one to the other, such as to improve the sealing characteristics of the closed container. The container can also be realised with a further addition of a sealing film 204. In this case, thanks to the particular solution described, the decouplability of the closing element from the container is guaranteed, and useful for example for inspecting the contents, while ensuring the hermetic closing of the compartment in the container.

Further, the method provides the possibility of operating with containers and caps that are undeformed, completing the packaging of the product and thus being able to realise the removable closing element only once the product has already been inserted in the container.

In other terms, the present method can be exploited with known-type containers and with closing elements that are already available on the market, enabling realisation of the threads both during the production stage and during the packaging stage, according to needs.

Moreover, the constructional simplicity of the apparatus for performing the deformations also enables design and construction of non-automatic machines for the manual realisation of the threads, even at point of sale of the product. The use of extensible paper for the container and/or the closing element enable optimisation of the fluid seal of the coupling, and also enable obtaining, on each of the two elements, deformations that would be impossible to realise using common papers.

Lastly, the possibility of creating an additional closing system by sealing guarantees the conservation of the product, avoiding any possible type of leakage of the product to the outside, while maintaining the operational possibility of removably opening/closing of the container on the part of the consumer.

Further, both the container and the closing element are made of a paper material and are therefore easier to eliminate once used.

The invention claimed is:

1. A process for making a reclosable container, starting from a sheet comprising the following steps:

predisposing, starting from a sheet material, a structure having internally thereof at least a chamber, the chamber exhibiting at least an access delimited by a portion of wall of the structure and by a free edge of the wall;

predisposing, starting from a sheet material, a closing element, having a base wall and a lateral wall emerging from the base wall;

predisposing, starting from a sheet material, a sealing layer placed superposingly on the base wall and on at least a portion of the lateral wall of the closing element;

associating the closing element and the sealing layer to the structure to at least partly close the access, the lateral wall of the closing element being positioned at the portion of the wall of the structure and the sealing layer comprising a lateral portion interposed between the portion of the lateral wall and the lateral wall of the closing element; and deforming at least a part of the lateral wall of the closing element and at least a part of the portion of wall of the container with the lateral portion of the layer interposed there-between;

the step of deforming being subsequent to the step of associating:

wherein the step of deforming comprises contemporaneous deforming of the lateral wall of the closing element, the part of the portion of wall of the container and the lateral portion of the layer interposed there-between, and making identical the shape of the part of the lateral wall of the closing element, of the part of the portion of wall of the container, and the lateral portion of the layer interposed there-between.

2. The process of claim 1, wherein the base wall and the lateral wall of the closing element are made following the deforming step an adhesion force per unit of surface is applied between the portion of wall of the container and the lateral portion of the layer that is significantly higher than an adhesion force per unit of surface between the lateral portion of the layer and the lateral wall of the closing element.

3. The process of claim 1, wherein the base wall and the lateral wall of the closing element are made of at least a first material, and the sealing layer is made of a second material which is different to the first material.

4. The process of claim 1, wherein the second material of the sealing layer comprises at least a continuous plastic film extending to close the chamber and able to make a substantial seal against gases;

wherein the first material of which the closing element is made is selected from a group and comprises:

a paper material, a paper material with a covering film, a paper material with a plurality of covering films among which at least a plastic film and at least a metal film, a paper material with a covering film, the covering film being a single polyolefin, a paper material with a plurality of covering films among which at least a plastic film including a polyolefin, and at least a metal film including aluminium;

wherein at least a layer of the base wall and the lateral wall of the closing element destined to be facing towards and in contact with the seal layer is made of a material which is not chemically compatible with the second material.

5. The process of claim 1, wherein the second material of the sealing layer comprises at least a continuous plastic film extending to close the chamber and able to realize a substantial seal against gases;

wherein the structure is made of a material selected from the group and comprising:

a paper material, a paper material with a covering film, a paper material with a plurality of covering films among which at least a plastic film and at least a metal film, a paper material with a covering film, the covering film being a single polyolefin, a paper material with a plurality of covering films among which at least a plastic film including a polyolefin, and at least a metal film including aluminium;

wherein at least a layer of the wall of the container destined to be facing towards and in contact with the sealing layer is made of a material which is chemically compatible with the second material.

6. The process of claim 1, wherein both the second material and the material of the at least a layer of the wall of the container destined to be facing and in contact with the sealing layer comprise a polyolefin.

7. The process of claim 1, wherein at least a part of the material forming the lateral portion of the sealing layer and/or at least a part of the material forming the portion of the wall comprises a plastic material which, during the deforming step, is brought to at least a softening temperature of the plastic material, the lateral portion consequently being sealingly welded to the portion of the wall.

8. The process of claim 1, wherein the deforming step comprises making, on the part of the lateral wall on the closing element, on the part of the portion of wall of the container and on the lateral portion of the wall interposed there-between, corresponding grooves.

9. The process of claim 8, wherein the deforming step comprises making grooves defining coupling/decoupling surfaces by rotation between the closing element and the container.

10. The process of claim 1, wherein:

the step of predisposing a structure comprising predisposing a container made of a paper material defining internally thereof at least a housing chamber, the chamber exhibiting an access delimited by the portion of wall of the container and by the free edge of the wall; and wherein associating comprises associating the container to the closing element made of paper material and the sealing layer to at least partially insert, through the access, the base wall of the closing element in the containing chamber, the lateral wall of the closing element being inserted internally of the container chamber at the portion of wall of the container and the sealing layer, thus making a sealed closing of the containing chamber.

11. The process of claim 1, wherein the deforming step enables obtaining grooves on the container, on the sealing layer and on the closing element in reciprocal coupling conditions thereof, wherein each of the grooves comprises respective threads arranged on the surface over a development of more than 120°, and wherein the lateral portion of the sealing layer extends along the grooves.

12. The process of claim 11, wherein each of the grooves comprises respective threads arranged on the surface over a development of more than 360°, and wherein the lateral portion of the sealing layer extends along the grooves.

13. The process of claim 1, wherein:

the deforming step comprises a substep of inserting a shaped portion into the cavity of the structure, the shaped portion exhibiting gullies facing externally of the shaped portion and further substeps of: predisposing mobile deforming organs external of the structure exhibiting ribs substantially complementarily-shaped to the gullies of the shaped portion; and moving the mobile organs nearingly to the structure such as to at least partially insert the ribs internally of the gullies, and wherein corresponding parts of the lateral wall of the closing element, the lateral portion of the layer and the portion of lateral wall of the container are trapped between the gullies and ribs and are deformed, following the nearing, to make the grooves for coupling/decoupling by rotation between the closing element and the container.

14. The process of claim 13, wherein:

the substep of moving the organs comprises a nearing thereof to the shaped portion in a direction contained in a perpendicular plane to a development axis of the container, the nearing direction being for example a radial direction, and wherein each mobile organ exhibits respective ribs, the ribs of all the mobile organs defining a continuous helical rib when in gripping conditions on the container.

* * * * *

UNITED STATES PATENT AND TRADEMARK OFFICE

CERTIFICATE OF CORRECTION

PATENT NO. : 9,126,714 B2
APPLICATION NO. : 13/877555
DATED : September 8, 2015
INVENTOR(S) : Giorgio Trani et al.

It is certified that error appears in the above-identified patent and that said Letters Patent is hereby corrected as shown below:

In the claims,

In column number 22, line number 57, in line 9 of Claim 13, please delete:

"to the structure such as to at least"

and insert therefor

--to the structure to at least--.

Signed and Sealed this
Nineteenth Day of January, 2016

Michelle K. Lee

Michelle K. Lee
*Director of the United States Patent and Trademark Office*